US012654080B2

(12) United States Patent
Bryant et al.

(10) Patent No.: US 12,654,080 B2
(45) Date of Patent: Jun. 16, 2026

(54) GOLF CLUB SENSOR HOUSING

(71) Applicant: KARSTEN MANUFACTURING CORPORATION, Phoenix, AZ (US)

(72) Inventors: Les J. Bryant, Peoria, AZ (US); Rick D. MacMillan, Glendale, AZ (US); Kelsey E. McGinty, Scottsdale, AZ (US); Paul D. Wood, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 784 days.

(21) Appl. No.: 18/047,574

(22) Filed: Oct. 18, 2022

(65) Prior Publication Data

US 2023/0123898 A1 Apr. 20, 2023

Related U.S. Application Data

(60) Provisional application No. 63/257,037, filed on Oct. 18, 2021.

(51) Int. Cl.
*A63B 60/46* (2015.01)
*A63B 53/14* (2015.01)
*A63B 60/16* (2015.01)

(52) U.S. Cl.
CPC ..... *A63B 60/46* (2015.10); *A63B 53/14* (2013.01); *A63B 60/16* (2015.10)

(58) Field of Classification Search
USPC ..... 473/300
See application file for complete search history.

(56) References Cited

U.S. PATENT DOCUMENTS

| | | | | |
|---|---|---|---|---|
| 6,753,778 | B2 * | 6/2004 | Kruger | A63B 60/16 340/568.1 |
| 8,182,361 | B2 | 5/2012 | Gill | |
| 8,613,676 | B2 | 12/2013 | Bentley | |
| 8,840,483 | B1 | 9/2014 | Steusloff et al. | |
| 8,894,502 | B2 * | 11/2014 | Rose | A63B 69/3632 473/226 |
| 8,926,444 | B2 | 1/2015 | Kato et al. | |
| 9,028,337 | B2 | 5/2015 | Bentley | |
| 9,033,810 | B2 * | 5/2015 | Bentley | A63B 69/36 473/316 |
| 9,412,979 | B2 * | 8/2016 | Yarmis | A63B 24/0062 |
| 9,643,049 | B2 | 5/2017 | Bentley et al. | |

(Continued)

FOREIGN PATENT DOCUMENTS

| | | |
|---|---|---|
| DE | 202014010974 | 3/2017 |
| KR | 100818169 | 4/2008 |

(Continued)

*Primary Examiner* — Steven S Paik

(57) ABSTRACT

Various embodiments of a golf club senor housing are described herein. The sensor housing can include a cover and a base that enclose a sensor therebetween. The sensor housing can be designed to sit on the end of a grip in a position that is non-obtrusive to the user. The sensor housing can further be configured to minimizes the impact on the center of gravity (CG) of the golf club by including mass reducing features. The sensor housing is also configured to sit lower on the grip and reduce the length that it projects outward from the grip butt end. Reducing the added length from the sensor housing creates a less-obtrusive feature.

20 Claims, 11 Drawing Sheets

(56) References Cited

U.S. PATENT DOCUMENTS

| | | | | |
|---|---|---|---|---|
| 9,676,094 | B1 * | 6/2017 | Davis | A63B 60/16 |
| 9,724,578 | B2 | 8/2017 | Zhao et al. | |
| 9,744,403 | B2 | 8/2017 | Rangel et al. | |
| 9,746,354 | B2 | 8/2017 | Martin et al. | |
| 9,968,826 | B2 | 5/2018 | McDonnell et al. | |
| 10,099,101 | B1 * | 10/2018 | Dingman | A63B 60/16 |
| 10,254,139 | B2 * | 4/2019 | Martin | G06F 3/0346 |
| 10,315,083 | B1 * | 6/2019 | Moreira | A63B 60/16 |
| 10,520,557 | B2 | 12/2019 | Sanchez et al. | |
| 10,603,558 | B2 | 3/2020 | Dingman et al. | |
| 10,610,753 | B1 * | 4/2020 | Davis | A63B 60/14 |
| 10,850,176 | B2 | 12/2020 | Oguchi et al. | |
| 2017/0182387 | A1 | 6/2017 | Phelan, Jr. | |
| 2021/0299531 | A1 * | 9/2021 | Kondo | A63B 60/46 |

FOREIGN PATENT DOCUMENTS

| | | |
|---|---|---|
| KR | 200488899 | 4/2019 |
| WO | 2000018477 | 4/2000 |

* cited by examiner

GOLF CLUB SENSOR HOUSING

CROSS REFERENCE PRIORITIES

This claims the benefit of U.S. Provisional Application No. 63/257,037, filed Oct. 18, 2021, which is incorporated by reference herein in its entirety.

FIELD OF THE INVENTION

The present disclosure relates to golf clubs and relates more particularly to golf clubs having sensors disposed within a sensor housing.

BACKGROUND

Golf clubs can be equipped with a sensor that records a golfer's shots and can pair with a smartphone app where the shot data can be viewed. Sensors can be secured within a sensor housing that is screwed into the butt end of a grip. However, the sensor housing can be an obtrusive addition to the end of a golf club. The sensor housing can add mass and length to the golf club grip, which may alter the center of gravity (CG) of the golf club. Some sensor housings hang over the edge of the grip footprint and do not conform with USGA regulations. For golfers who grip near the butt end, this overhang can be distracting during his or her swing. Further, the sensor housing may also be difficult to manufacture. Some sensor housings require the sensor to be secured with an adhesive, which increases the structural weight of the sensor housing. Therefore, there is a need in the art for a non-obtrusive sensor housing that is easy to manufacture.

BRIEF DESCRIPTION OF THE DRAWINGS

To facilitate further description of the embodiments, the following drawings are provided in which.

Figure 1:
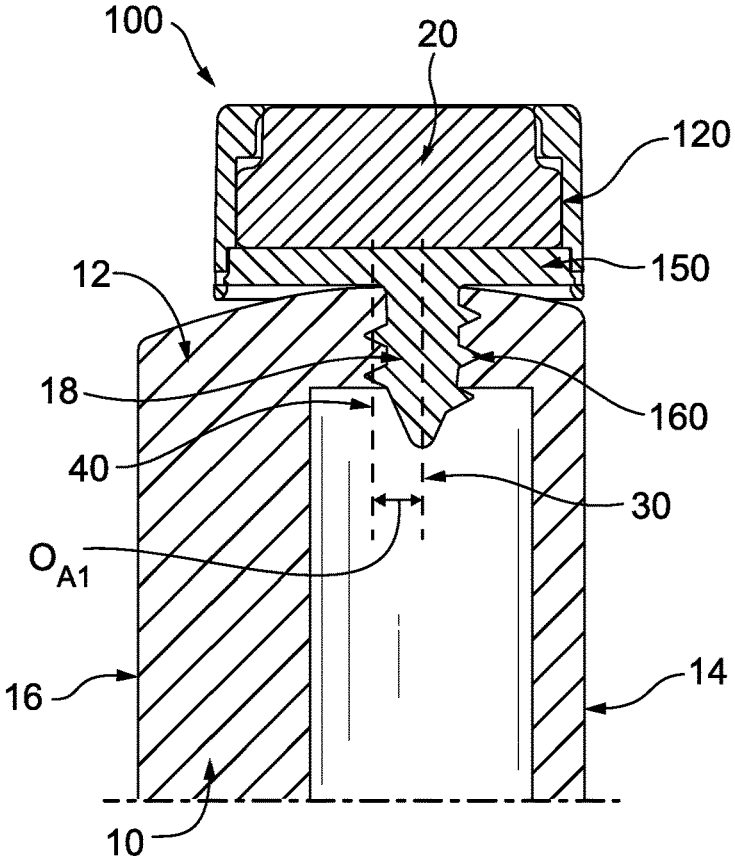
FIG. 1 illustrates a cross-sectional view of a golf club grip comprising a sensor housing, according to a first embodiment.

Some golf club grips are configured to receive a sensor for recording shot data. The sensor is encapsulated within a sensor housing that is received by the grip. The present invention is a sensor housing designed to be non-obtrusive and easy to manufacture. The sensor housing comprises a base that sits beneath the sensor, and a cover that is placed over the sensor and snapped onto the base. The base comprises a post that is received by the grip to secure the sensor housing to the grip. The sensor housing remains within the grip perimeter to conform with USGA regulations and prevent the golfer from being distracted by the sensor. To achieve this configuration, the post is positioned at an offset to move the sensor housing toward the grip front side. The grip is wider near the front side and can accommodate a larger portion of the sensor housing than the rear side.

The sensor housing also minimizes the impact on the center of gravity (CG) of the golf club by including mass reducing features and reducing the length that the sensor housing adds to the grip. The sensor housing can sit flush with the grip such that at least 50% of the sensor housing base contacts a surface of the grip. The sensor housing can include ribs to secure the sensor, which lower the mass in comparison to a solid ring of material. The sensor housing is also configured to sit lower on the grip and reduce the length that it projects outward from the grip butt end. Reducing the added length from the sensor housing creates a less-obtrusive feature.

The sensor housing is also designed to provide a secure structure for the sensor. The cover and base are configured to flex slightly to be able to snap together, while being rigid enough to protect the sensor. The cover and base are not removable once snapped together. The cover and the base are designed with a non-removable connection to provide a secure housing for the sensor that cannot be easily disassembled.

The sensor housing also provides a threaded post that is configured to interact with an aperture in the grip. The threaded post is screwed into the grip aperture, securing the sensor housing firmly atop the grip butt end in a secure, low-profile orientation. The threads are formed from the same material as the post and base in a single mold, providing manufacturing benefits. The threads can include thickened portions that help retain the post within the grip aperture.

The sensor housing also provides manufacturing benefits. The sensor housing does not require the sensor to be secured with an adhesive, thereby reducing the structural weight of the sensor housing. The cover and the base are formed separately, which allows that to be formed from different materials. The base can then be easily formed with the post. The sensor housing described herein can be used with various sports items such as golf clubs, bats, or rackets.

"Longitudinal axis" as described herein is an axis that extends through the grip from a geometric center of the grip butt end to a geometric center of the grip tip end.

"Grip aperture axis" as described herein is an axis that extends through a center of the grip aperture.

"Grip perimeter" as described herein is the surface of the grip near the butt end that is bounded by the grip edges. The grip perimeter is essentially the surface area that is visible when viewing the grip from the butt end.

"Cross-sectional shape" of the grip as described herein is the shape of the grip defined within a boundary of the outer surface and viewed in a plane orthogonal to the longitudinal axis. Since the grip is flexible, the cross-sectional shape varies slightly when the grip is mounted onto a shaft. The size of the shaft also affects the mounted grip dimensions.

"Sensor" as described herein is a shot recording device situated near the butt end of the grip. The sensor can be secured within a sensor housing.

The grip can define a length, measured along the longitudinal axis from the butt end to the tip end. The grip length can be between 9.5 inches and 11.5 inches. In some embodiments, the grip length can be 9.5 inches, 9.75 inches, 10 inches, 10.25 inches, 10.5 inches, 10.75 inches, 11 inches, 11.25 inches, or 11.5 inches. The end cap can increase the length of the grip, making the grip longer than a grip without a sensor. In one embodiment, the end cap can extend the grip length 0.41 inches.

The terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "top," "over," "lower," "upper," "lower," "inner," "outer," "maximum," "taper," "chamfer," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

DETAILED DESCRIPTION

Figure 12:
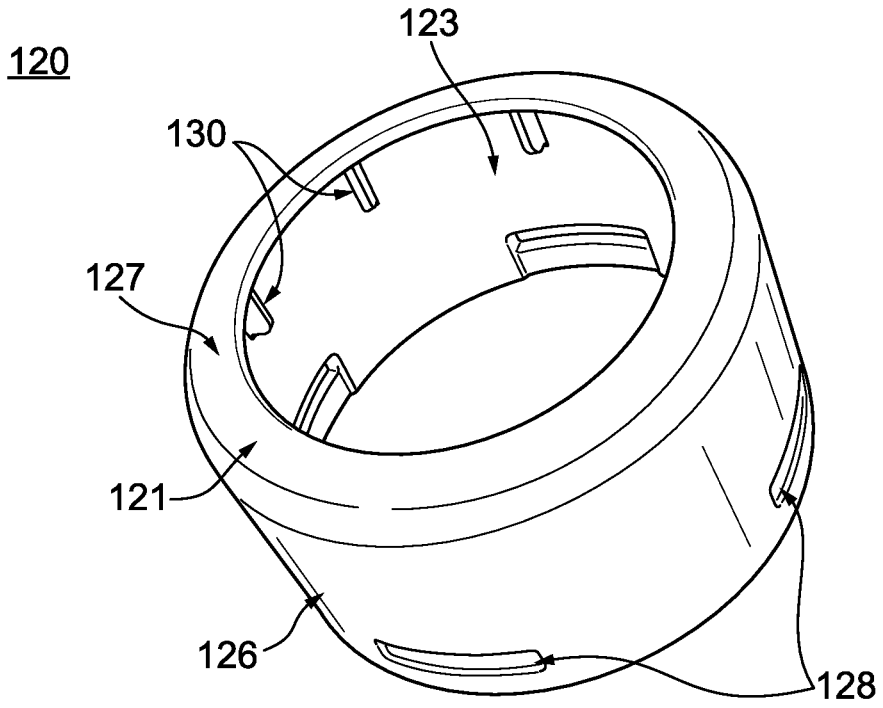
FIG. 12 illustrates a top perspective view of the sensor housing cover of FIG. 1.

Described herein are various embodiments of a sensor housing configured to enclose a sensor and be secured to the butt end of a golf club grip. The positioning of the sensor housing is not distracting or obtrusive to the user during their swing. Referring to the drawings, FIGS. 1 and 12 illustrate various embodiments of the sensor housing described herein. The features discussed below are demonstrated on the sensor housing 100. For ease of discussion, like reference numerals are used to identify like or identical components in various embodiments of the sensor housing according to the present invention. Any one or more of the features discussed below can be used in combination with one another.

Figure 3:
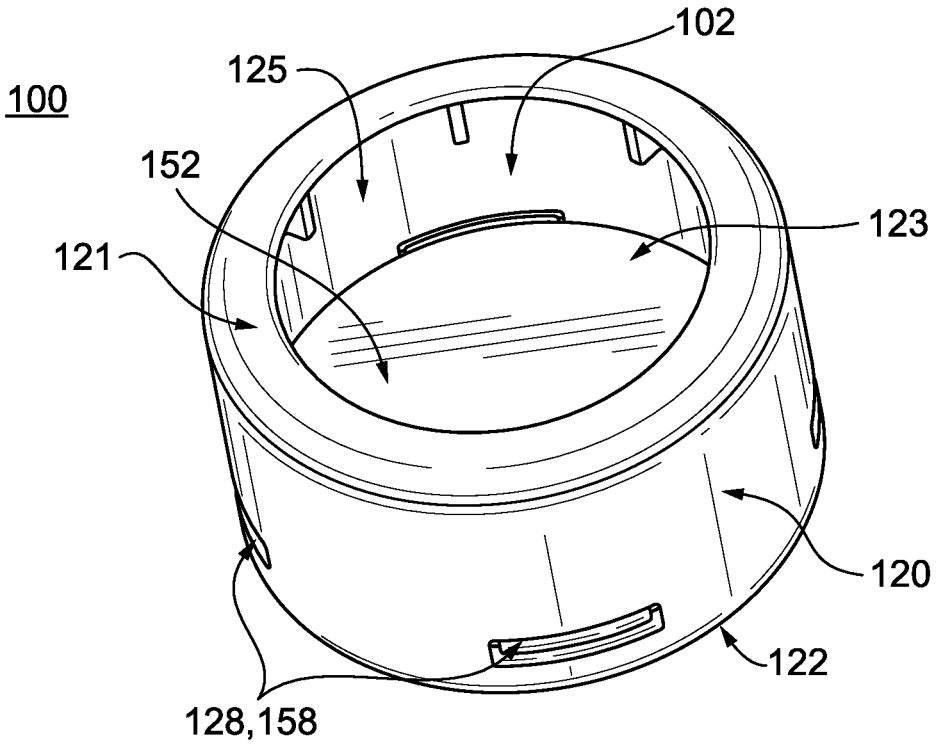
FIG. 3 illustrates a top perspective view of the sensor housing of FIG. 1.
Figure 4:
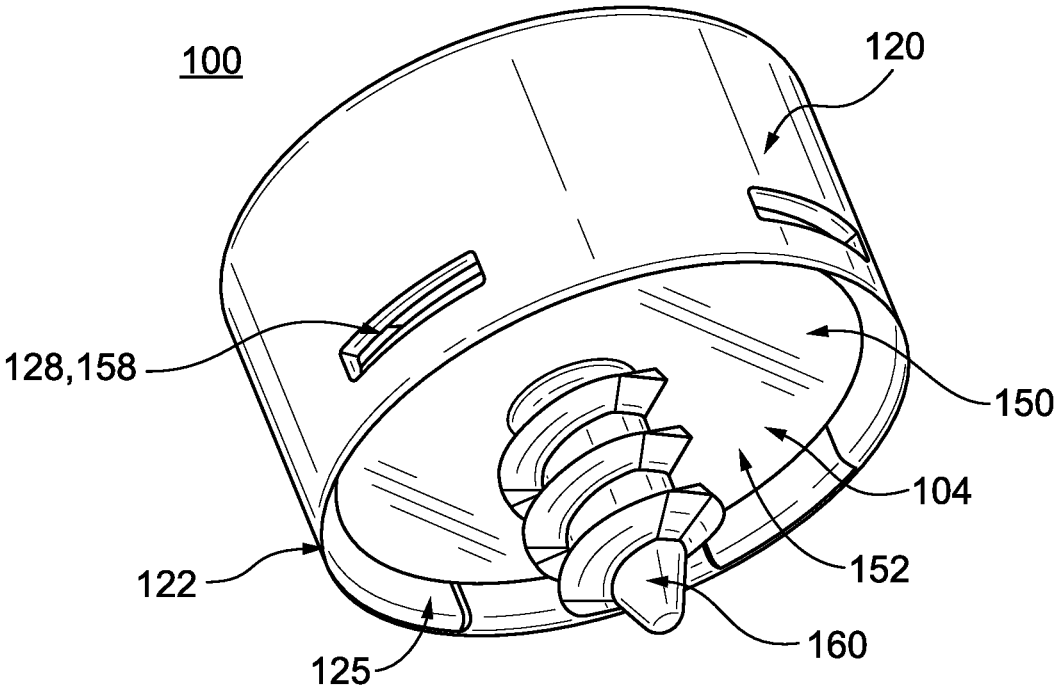
FIG. 4 illustrates a bottom perspective view of the sensor housing of FIG. 1.
Figure 5:
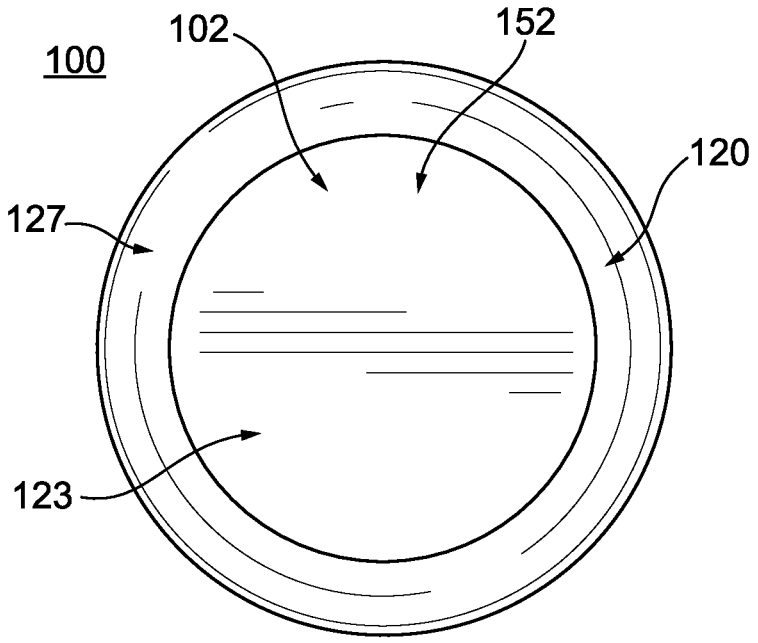
FIG. 5 illustrates a top view of the sensor housing of FIG. 1.
Figure 6:
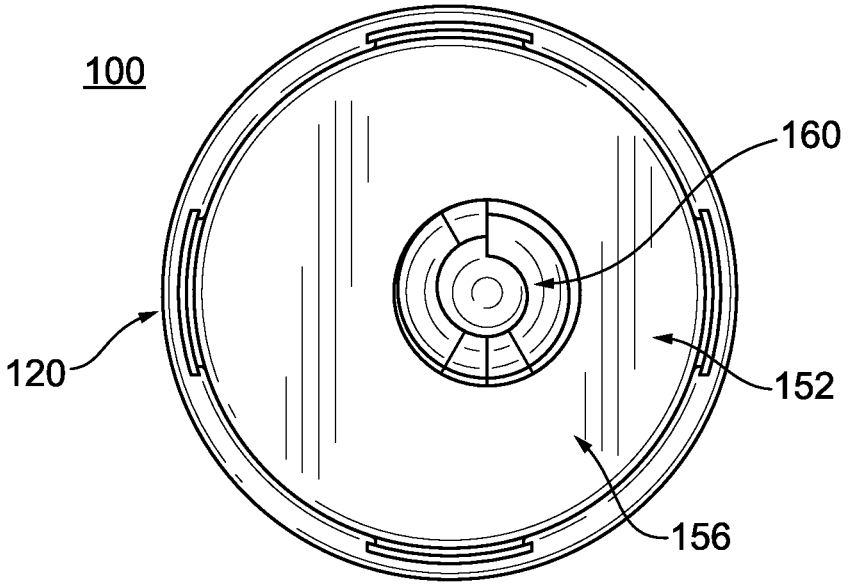
FIG. 6 illustrates a bottom view of the sensor housing of FIG. 1.

Referring to FIGS. 3 and 4, the sensor housing 100 comprises a cover 120 and a base 150 that snap together to encapsulate a sensor 20. In some embodiments, the base 150 comprises a plurality of tabs 158 that are received within a plurality of windows 128 defined on the cover 120. In these embodiments, the tabs 158 and the windows 128 facilitate the connection between the base 150 and the cover 120. To secure the sensor housing 100 to the grip 10, the base 150 further comprises a post 160 that is received through an aperture 18 defined by the grip 10 (the "grip aperture"). The construction of the sensor housing 100 is discussed in more detail below, as is the positioning of the sensor housing 100 in relation to the grip aperture 18

Figure 2:
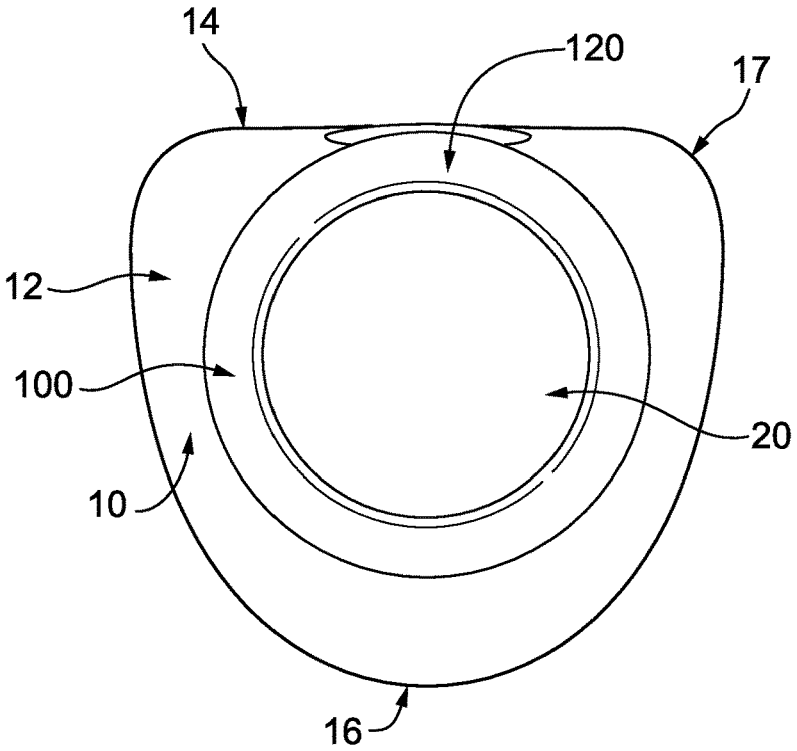
FIG. 2 illustrates a top view of a golf club grip comprising the sensor housing of FIG. 1.

One key feature of the sensor housing design is the positioning of the sensor housing 100 relative to the grip butt end 12. The sensor housing 100 is designed to be not noticed (hereafter "non-obtrusive") to the user to prevent an awkward or disrupting feeling when holding the grip 10. To achieve a non-obtrusive configuration, the sensor housing 100 does not extend beyond the grip perimeter 17, as illustrated in FIGS. 1 and 2. In other words, the sensor housing 100 remains within the grip perimeter 17 to prevent the user from noticing the sensor housing 100 when holding the grip.

FIG. 2 illustrates a top-down (or butt-end) view of the grip 10, where the sensor housing 100 is installed. In the top-down view, an outer surface of the grip 10 defines a grip perimeter 17. The grip perimeter 17 defines a circumferential region of the grip 10, where the user holds the grip 10. The various embodiments of the sensor housing 100 described herein are designed to remain within the grip perimeter 17 to prevent the user from noticing the sensor housing 100 during their swing. FIGS. 1 and 2 illustrate that the sensor housing 100 does not extend beyond the grip front side 14, the grip rear side 16, or the sides of the grip 10. A uniform, consistent surface without an outwardly protruding sensor housing provides a favorable tactile sensation for golfers who wish to maintain a seamless feel during a golf swing.

Various aspects of both the sensor housing 100 and/or the grip 10 can be tailored to achieve this positioning. In some embodiments, the location of the grip aperture 18 can be selected to carefully position the sensor housing 100 within the grip perimeter 17. The location of the grip aperture 18 is dependent on the cross-sectional shape of the grip 10. As such, certain grips require the location of the grip aperture 18 to be adjusted to position the sensor housing 100 within the grip perimeter 17. Some grips 10 comprise symmetrical cross-sectional shapes, which allows the grip aperture 18 and sensor housing 100 to be centered on the grip butt end 12. For example, some grips 10 can have a symmetrical, circular cross-sectional shape that can accommodate a symmetrical sensor housing. Other grips 10 can comprise an asymmetrical cross-sectional shape, which requires repositioning of the grip aperture 18. For example, the grip 10 illustrated in FIG. 2 is wider near a grip front side 14 and narrower towards the grip rear side 16. In these embodiments, the grip aperture 18 is positioned near the grip front side 14 to position the sensor housing 100 in the wider, forward portion of the grip 10. The location of the grip aperture 18 can be adjusted on any grip 10 to provide optimal positioning of the sensor housing 100. The grip aperture 18 can be positioned at an offset in the front-to-back direction and/or an offset in the heel-to-toe direction.

The front-to-back location of the grip aperture 18 is described as a first aperture offset $O_{A1}$. Referring to FIG. 1, the aperture offset $O_{A1}$ is measured in a front-to-back direction as the distance from a grip aperture axis 30 to the longitudinal axis 40. FIG. 1 illustrates a grip aperture 18 positioned closer to the grip front side 14, and therefore, a forward aperture offset $O_{A1}$. However, in other embodiments, the grip aperture 18 can be positioned closer to the grip rear side 16, producing a rearward aperture offset $O_{A1}$. In many embodiments, the aperture offset $O_{A1}$ is between 0.010 inch to 0.100 inch. In some embodiments, the aperture offset $O_{A1}$ is between 0.010 inch to 0.050 inch, 0.025 inch to 0.075 inch, 0.050 inch to 0.060 inch, or 0.055 inch to 0.100 inch. In some embodiments, the aperture offset $O_{A1}$ is approximately 0.010 inch, 0.015 inch, 0.020 inch, 0.025 inch, 0.030 inch, 0.035 inch, 0.040 inch, 0.045 inch, 0.050 inch, 0.055 inch, 0.060 inch, 0.065 inch, 0.070 inch, 0.075 inch, 0.080 inch, 0.085 inch, 0.090 inch, 0.095 inch, or 0.100 inch. In one exemplary embodiment, the aperture offset $O_{A1}$ is 0.060 inch. The aperture offset $O_{A1}$ is dependent on the size and cross-sectional shape of the grip 10. In many embodiments, the first aperture offset $O_{A1}$ helps to address asymmetrical grips. The first aperture offset $O_{A1}$ corresponds to the first post offset $O_{P1}$, as described in more detail below. Together, the first aperture offset $O_{A1}$, and the first post offset Op help position the sensor housing 100 within the grip perimeter 17.

In many embodiments, the grip aperture 18 is centered in a heel-to-toe direction. However, in some embodiments, the grip aperture 18 can be located closer to either the heel or the toe. In these embodiments, the heel-to-toe location of the grip aperture 18 is described as a second aperture offset $O_{A2}$. The second aperture offset $O_{A2}$ is measured in a heel-to-toe direction as the distance from the grip aperture axis 30 to the longitudinal axis 40 (not shown). In many embodiments, the aperture offset $O_{A2}$ is between 0.010 inch to 0.100 inch. In some embodiments, the aperture offset $O_{A2}$ is between 0.010 inch to 0.050 inch, 0.025 inch to 0.075 inch, 0.050 inch to 0.060 inch, or 0.055 inch to 0.100 inch. In some embodiments, the aperture offset $O_{A2}$ is approximately 0.010 inch, 0.015 inch, 0.020 inch, 0.025 inch, 0.030 inch, 0.035 inch, 0.040 inch, 0.045 inch, 0.050 inch, 0.055 inch, 0.060 inch, 0.065 inch, 0.070 inch, 0.075 inch, 0.080 inch, 0.085 inch, 0.090 inch, 0.095 inch, or 0.100 inch. The aperture offset $O_{A2}$ is dependent on the size and cross-sectional shape of the grip 10. In many embodiments, the second aperture offset $O_{A2}$ helps to address asymmetrical grips. The second aperture offset $O_{A2}$ corresponds to the second post offset $O_{P2}$, as described in more detail below. Together, the second aperture offset $O_{A2}$ and the second post offset $O_{P2}$ help position the sensor housing 100 within the grip perimeter 17 and align the post 160 with the grip aperture 18.

The grip aperture 18 comprises a grip aperture diameter measured across the opening (not shown). In many embodiments, the grip aperture diameter is between 0.10 inch to 0.14 inch. In some embodiments, the grip aperture diameter is between 0.10 inch to 0.13 inch, 0.11 inch to 0.13 inch, or 0.12 inch to 0.14 inch. In some embodiments, the grip aperture diameter is approximately 0.10 inch, 0.11 inch, 0.12 inch, 0.13 inch, or 0.14 inch. In one exemplary embodiment, the grip aperture diameter is approximately 0.125 inch. The grip aperture diameter corresponds to the post diameter to allow the post 160 to be received within the grip aperture 18. The post 160 is received within the grip aperture 18 such that a tight connection is formed therebetween. The connection between the post 160, and the grip aperture 18 is tight enough that the sensor housing 100 presses into the grip 10. In some embodiments, the grip aperture 18 is threaded to receive a threaded post 160, as illustrated in FIG. 1. In other embodiments, the grip aperture 18 is not threaded. The sizing and positioning of the grip aperture 18 are selected to locate the sensor housing 100 in a position that is non-obtrusive to the user while holding the grip 10. Further, the grip aperture 18 is configured to receive the sensor housing 100, and firmly secure it into place.

Another key feature of the sensor housing design is the flexible yet rigid construction of the sensor housing 100. The sensor housing 100 provides a secure structure for the sensor 20, while allowing the sensor housing to be assembled over a sensor 20. As discussed above, the sensor housing 100 comprises a cover 120 and a base 150 that snap together to encapsulate a sensor 20. Referring to FIGS. 1 and 3, the sensor 20 is positioned within a sensor cavity 102 defined between the cover 120 and the base 150. The cover 120 and base 150 are configured to flex slightly to be able to snap together, while being rigid enough to protect the sensor 20. In many embodiments, the cover 120 and base 150 are not removable once snapped together, constituting a permanently configured assembly.

As discussed above, the cover 120 is designed to encapsulate an upper portion of the sensor 20, and the base 150 sits beneath the sensor 20 and secures the sensor housing 100 to the grip 10. A sensor 20 is placed on the base 150, and the cover 120 is placed over the sensor 20 and snapped into place. The interaction between the cover 120 and the base 150 can be facilitated by various features located on the cover 120 and the base 150 that interact or correspond with one another. As discussed in more detail below, this interaction can be facilitated by corresponding tabs and windows, corresponding notches and indentations, or any other suitable features.

Once assembled, the sensor housing 100 is positioned within the grip aperture 18, which is carefully positioned to prevent the sensor housing 100 from hanging over the grip perimeter 17. In many embodiments, the sensor housing 100 is designed to conform with the placement of the grip aperture 18. In some embodiments, the base 150 is designed to shift the sensor housing 100 closer to the grip front side 14.

Figure 9:
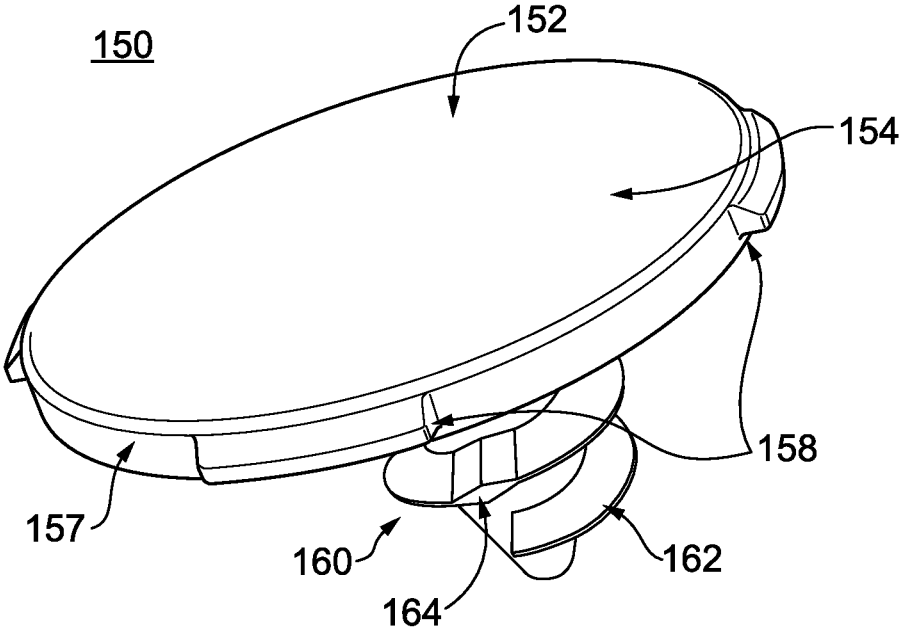
FIG. 9 illustrates a top perspective view of the sensor housing base of FIG. 1.
Figure 10:
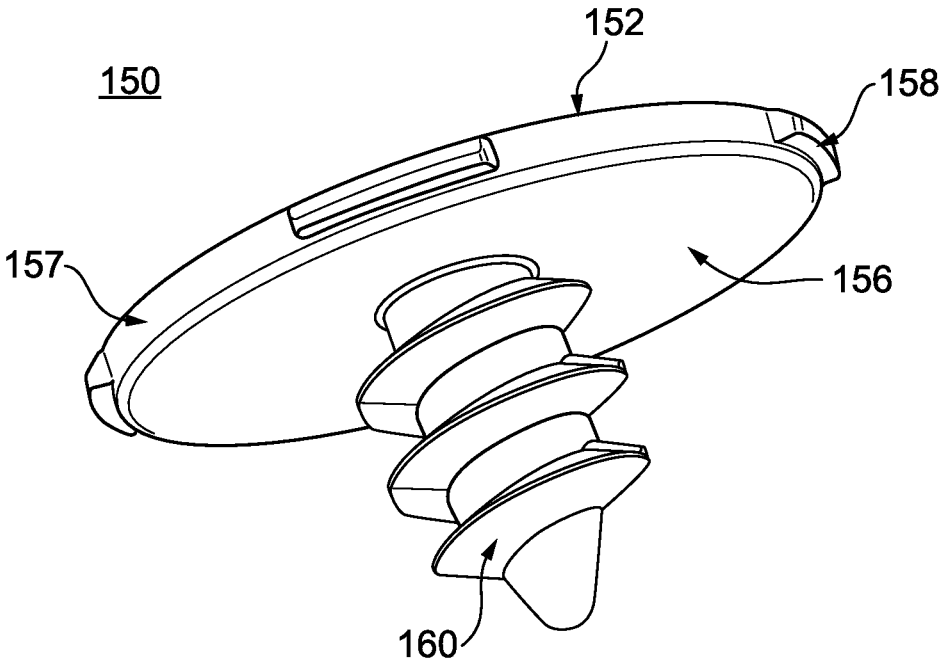
FIG. 10 illustrates a bottom perspective view of the sensor housing base of FIG. 1.
Figure 11:
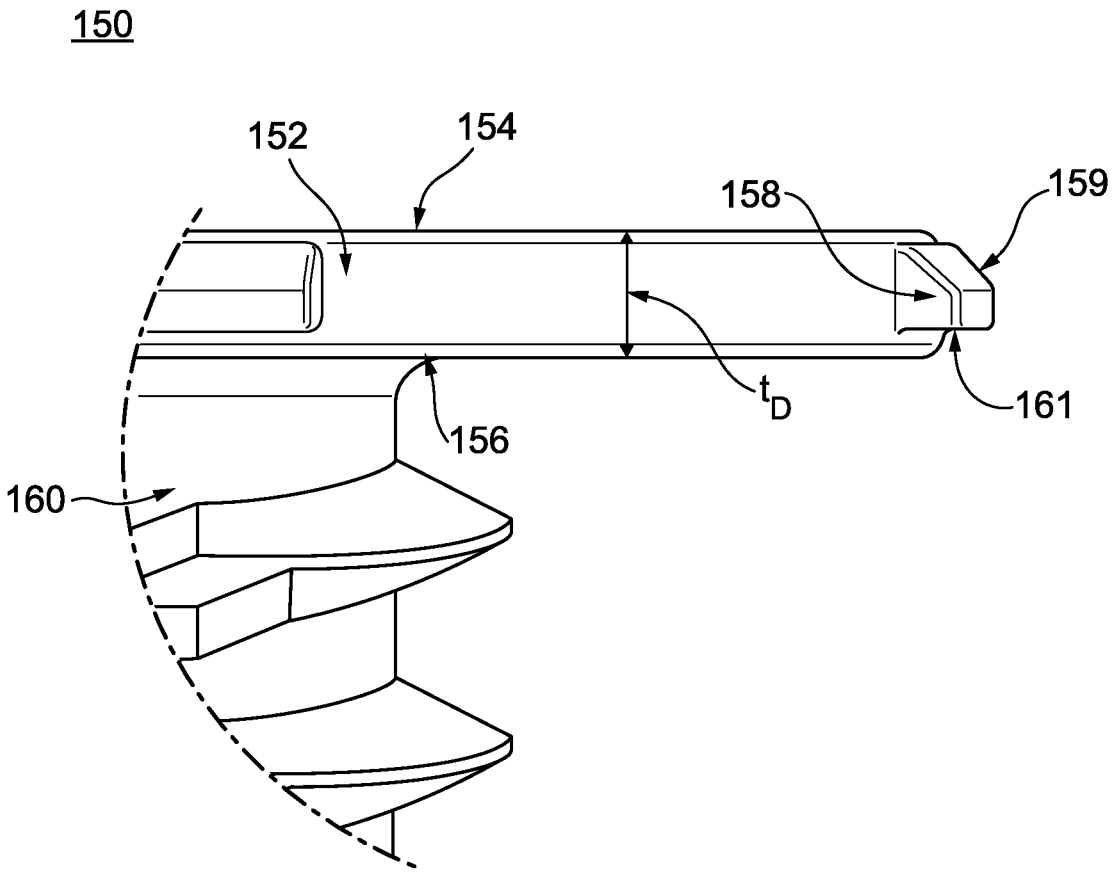
FIG. 11 illustrates a close-up, side view of the sensor housing base of FIG. 1.

The base 150 is the lower portion of the sensor housing 100 located below the sensor 20. Referring to FIGS. 9-11, the base 150 comprises a disk 152 and a post 160 that extends from the disk 152. The post 160 is formed integrally with the disk 152 via a single flat parting line mold. The disk 152 is the portion of the base 150 that is secured to the cover 120, while the post 160 is secured within the grip aperture 18.

Referring to FIGS. 9 and 10, the disk 152 comprises a top surface 154, a bottom surface 156 opposite the top surface 154, and a perimeter 157 that circumscribes the outer edge of the disk 152. In many embodiments, the disk top surface 154 is a substantially flat surface that supports the sensor. Referring to FIG. 1, the disk top surface 154 is adjacent to a bottom surface of the sensor 20, and the disk bottom surface 156 is adjacent to the grip 10.

In some embodiments, the disk 152 further comprises a plurality of tabs 158 (hereafter referred to as "tabs") protruding from the perimeter 157. The tabs 158 project from the perimeter 157 such that they are parallel to the disk top and bottom surfaces 154, 156. The tabs 158 are received within a plurality of windows defined by the cover 120, as illustrated in FIGS. 3 and 4. As such, the tabs 158 can allow the disk 152 (and the base 150) to be received within the cover 120. The base 150 and the cover 120 are formed separately and snapped together over the sensor 20. Once in place, the base 150 and the cover 120 are not removable from one another. The non-removable connection between the cover 120 and the base 150 provides a secure sensor housing 100 without the need for an adhesive material. In many embodiments, the tabs 158 are shaped to allow the base 150 and the cover 120 to be snapped together, without allowing them to be removed.

In many embodiments, the tabs 158 comprise a shape such as rectangular or trapezoidal in a cross-sectional or side view. For example, FIG. 11 illustrates one embodiment of the tabs 158 in which the tabs 158 define a trapezoidal shape in a side view. In these embodiments, a tab top surface 159 is chamfered, and a tab bottom surface 161 is flat. The tab top surface 159 can be chamfered to allow the tabs 158 to glide into place when received by the cover 120. In many embodiments, the tab bottom surface 161 can be flat to prevent the base 150 from being removed from the cover 120. In some embodiments, each tab 158 comprises the same shape as the adjacent tabs 158, as illustrated in FIG. 11. In other embodiments, each tab 158 comprises a different shape than the adjacent tabs 158. In many embodiments, the tabs 158 can comprise a shape similar to that of the corresponding windows 128 to allow the windows 128 to receive the tabs 158. The tabs 158 provide a lightweight mechanism for securing the base 150 to the cover 120. Therefore, the tabs 158 help provide a non-obtrusive sensor housing 100 by not significantly increasing the structural mass of the sensor housing 100.

The disk 152 can comprise any suitable number of tabs 158 to allow the cover 120 to be secured to the base 150. For example, the disk 152 can comprise between 2 to 4 tabs, 3 to 6 tabs, 4 to 8 tabs, or 5 to 10 tabs. In some embodiments, the disk 152 can comprise 1 tab, 2 tabs, 3 tabs, 4 tabs, 5 tabs, 6 tabs, 7 tabs, 8 tabs, 9 tabs, or 10 or more tabs. FIGS. 9 and 10 illustrate one embodiment of the base 150, wherein the disk 152 comprises 4 tabs 158. In most embodiments, the number of tabs 158 corresponds to the number of windows 128 located on the cover 120. In some embodiments, the tabs 158 are equally spaced apart from one another. In other embodiments, the tabs 158 are not equally spaced apart from one another. The tabs 158 are located around the disk perimeter 157 to allow the disk 152 (and the base 150) to be received by the cover 120. Therefore, the sizing, shaping, and positioning of the tabs 158 are selected to ensure that the tabs 158 can be secured within the windows 128 of the cover 120. In some embodiments, the shaping, and dimensions of the tabs 158 alter the dimensions of the disk 152.

Figure 18:
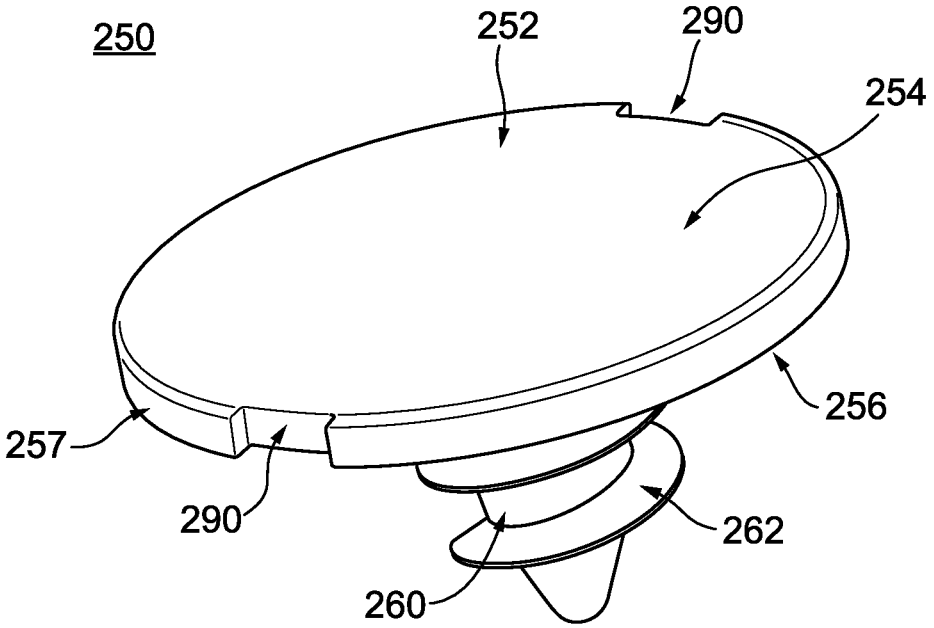
FIG. 18 illustrates a top perspective view of the sensor housing base of FIG. 15.

The disk 152 comprises a diameter measured across the disk top surface 154 through a center of the disk 152 (not shown). In many embodiments, the disk diameter is between 0.70 inch and 0.90 inch. In some embodiments, the disk diameter is between 0.70 inch to 0.80 inch, 0.75 inch to 0.90 inch, or 0.80 inch to 0.90 inch. In some embodiments, the disk diameter is approximately 0.70 inch, 0.71 inch, 0.72 inch, 0.73 inch, 0.74 inch, 0.75 inch, 0.76 inch, 0.77 inch, 0.78 inch, 0.79 in, 0.80 inch, 0.81 inch, 0.82 inch, 0.83 inch, 0.84 inch, 0.85 inch, 0.86 inch, 0.87 inch, 0.88 inch, 0.89 in, or 0.90 inch. In one exemplary embodiment, the disk diameter is 0.79 inch. In some embodiments, the diameter of the disk 152 can vary to depending on the presence of features such as tabs or indented portions. For example, FIG. 9 illustrates one embodiment of the disk 152, where the diameter is greater near the portions comprising tabs 158. As discussed in more detail below, FIG. 18 illustrates another embodiment of the disk 252, where the diameter is smaller near the indented portions 290. In many embodiments, the diameter of the disk 152 corresponds to the diameter of the cover 120 to allow the cover 120 to receive the disk 152.

Referring to FIG. 11, the disk 152 further comprises a thickness $t_D$ measured from the disk top surface 154 to the disk bottom surface 156. In many embodiments, the thickness $t_D$ is between 0.01 inch to 0.25 inch. In some embodiments, the thickness $t_D$ is between 0.01 inch to 0.15 inch, 0.10 inch to 0.20 inch, or 0.15 inch to 0.25 inch. In some embodiments, the thickness $t_D$ is approximately 0.010 inch, 0.015 inch, 0.020 inch, 0.025 inch, 0.030 inch, 0.035 inch, 0.040 inch, 0.045 inch, 0.050 inch, 0.055 inch, 0.060 inch, 0.065 inch, 0.070 inch, 0.075 inch, 0.080 inch, 0.085 inch, 0.090 inch, 0.095 inch, 0.10 inch, 0.11 inch, 0.12 inch, 0.13 inch, 0.14 inch, 0.15 inch, 0.16 inch, 0.17 inch, 0.18 inch, 0.19 in, 0.20 inch, 0.21 inch, 0.22 inch, 0.23 inch, 0.24 inch, or 0.25 inch. In one exemplary embodiment, the thickness $t_D$ is 0.060 inch. In many embodiments, the thickness $t_D$ is substantially constant throughout the disk 152 to accommodate a sensor 20 having a flat bottom surface. However, in some embodiments, the thickness $t_D$ can vary throughout the disk 152. The thickness $t_D$ is selected to ensure that the disk 152 is flexible yet durable enough to be inserted into the cover 120. The thickness $t_D$ is also minimized to ensure the disk 152 does not significantly add to the structural mass of the sensor housing 100. Minimizing the structural weight of each of the features helps provide a non-obtrusive sensor housing that does not significantly affect the center of gravity of the golf club.

The base 150 serves multiple purposes to the sensor housing 100. As discussed above, the tabs 158 form the necessary connection with the cover 120 to secure the sensor 20 therebetween. In addition, the post 160, which projects from the disk 152, secures the sensor housing 100 to the grip 10. More specifically, the post 160 extends from the disk bottom surface 156 through the grip aperture 18, thereby anchoring the base 150 (and the sensor housing 100) to the grip 10. The post 160 is formed along the longitudinal axis 40. In some embodiments, the post 160 is not threaded. However, in most embodiments, the post 160 is threaded to interact with a threaded grip aperture 18.

Figure 8:
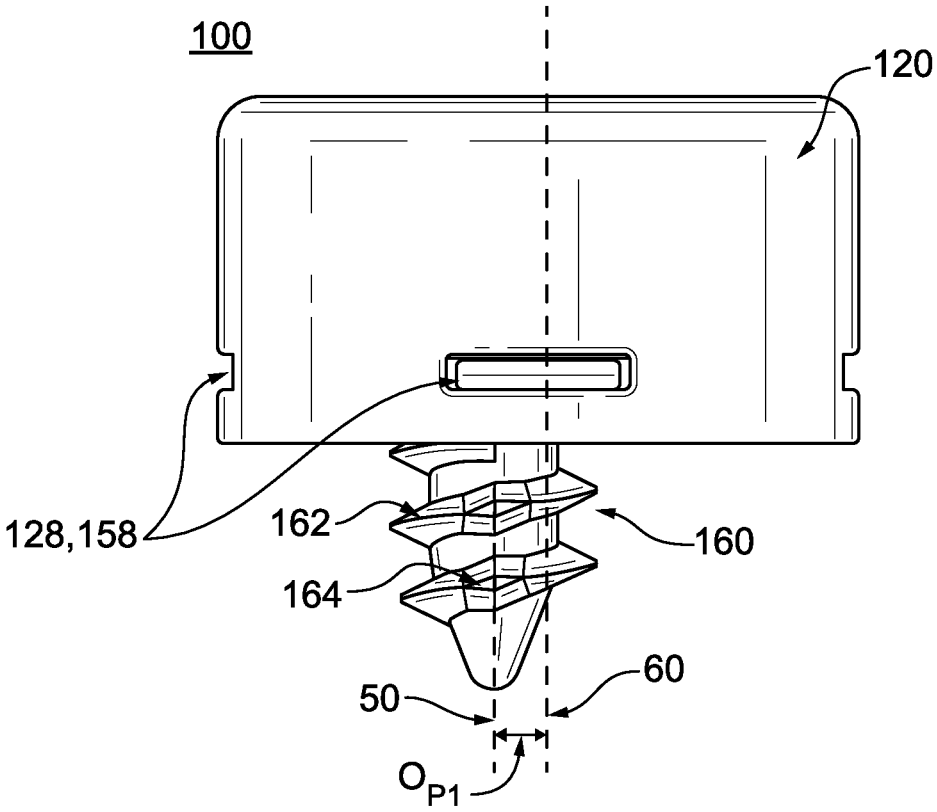
FIG. 8 illustrates a left side view of the sensor housing of FIG. 1.

As discussed above, the sensor housing 100 is designed to remain within the grip perimeter 17 to provide a non-obtrusive housing for the sensor 20. Depending on the sizing and shaping of the grip 10, various features of the sensor housing 100 can be tailored to position the sensor housing 100 within the grip perimeter 17. In some embodiments, the base 150 is designed to shift the sensor housing 100 closer to the grip front side 14. To shift the sensor housing 100 forward, the post 160 is positioned closer to a front side of the sensor housing 100 (and closer to the grip front side 14). FIG. 8 illustrates a side view of the sensor housing 100 showing the forward positioning of the post 160. The location of the post 160 relative to the disk 152 is described as a post offset Op.

The front-to-back location of the post 160 is described as a first post offset $O_{P1}$. Referring to FIG. 8, the first post offset $O_{P1}$ is measured in a front-to-back direction as the distance from a post axis 50 to a central axis 60 of the sensor housing 100. FIG. 8 illustrates a post 160 positioned closer to the grip front side 14, and therefore, a forward post offset $O_{P1}$. However, in other embodiments, the post 160 can be positioned closer to the grip rear side 16, producing a rearward post offset $O_{P1}$. In many embodiments, the first post offset $O_{P1}$ is between 0.010 inch to 0.100 inch. In some embodiments, the first post offset $O_{P1}$ is between 0.010 inch to 0.050 inch, 0.025 inch to 0.075 inch, 0.050 inch to 0.060 inch, or 0.055 inch to 0.100 inch. In some embodiments, the first post offset $O_{P1}$ is approximately 0.010 inch, 0.015 inch, 0.020 inch, 0.025 inch, 0.030 inch, 0.035 inch, 0.040 inch, 0.045 inch, 0.050 inch, 0.055 inch, 0.060 inch, 0.065 inch, 0.070 inch, 0.075 inch, 0.080 inch, 0.085 inch, 0.090 inch, 0.095 inch, or 0.100 inch. In one exemplary embodiment, the first post offset $O_{P1}$ is 0.060 inch. The first post offset $O_{P1}$ corresponds to the first aperture offset $O_{A1}$, as described in better detail below. The first post offset $O_{P1}$ is dependent on the size and cross-sectional shape of the grip 10. Together, the first aperture offset $O_{A1}$ and the first post offset Op help position the sensor housing 100 within the grip perimeter 17.

Figure 7:
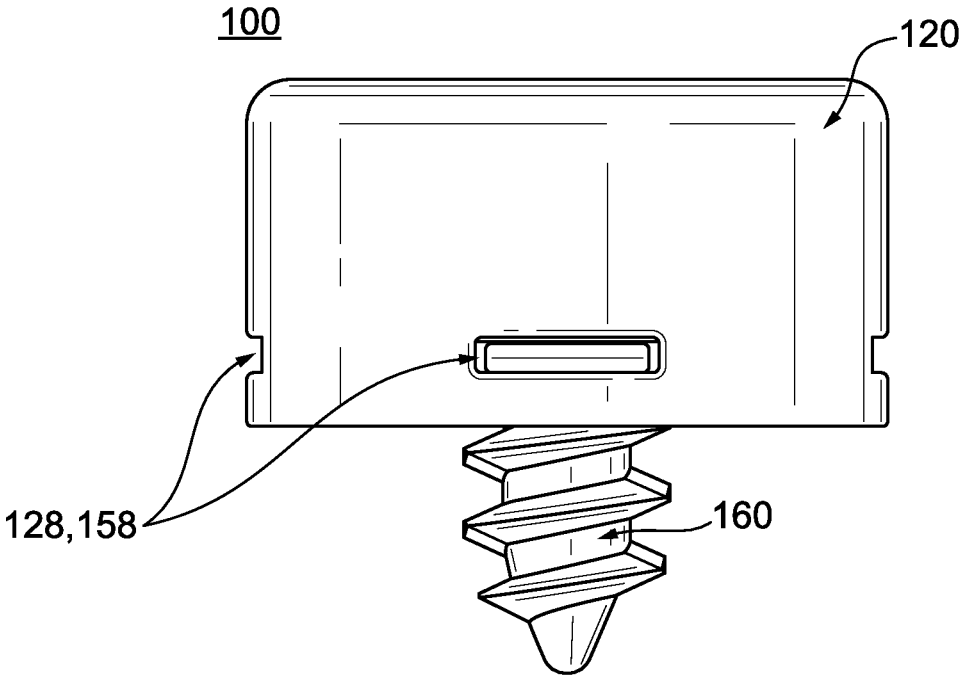
FIG. 7 illustrates a front view of the sensor housing of FIG. 1.

In many embodiments, the post 160 is centered on the disk 152 in a heel-to-toe direction. For example, FIG. 7 illustrates a front side view of the sensor housing 100, where the post 160 is centered on the disk 152 in the heel-to-toe direction. However, in some embodiments, the post 160 can be located closer to either the heel or the toe. In these embodiments, the heel-to-toe location of the post 160 is described as a second post offset $O_{P2}$. The second post offset $O_{P2}$ is measured in a heel-to-toe direction as the distance from the post axis 50 to a central axis 60 of the sensor housing 100 (not shown). In many embodiments, the second post offset $O_{P2}$ is between 0.010 inch to 0.100 inch. In some embodiments, the second post offset Op is between 0.010 inch to 0.050 inch, 0.025 inch to 0.075 inch, 0.050 inch to 0.060 inch, or 0.055 inch to 0.100 inch. In some embodiments, the second post offset Op is approximately 0.010 inch, 0.015 inch, 0.020 inch, 0.025 inch, 0.030 inch, 0.035 inch, 0.040 inch, 0.045 inch, 0.050 inch, 0.055 inch, 0.060 inch, 0.065 inch, 0.070 inch, 0.075 inch, 0.080 inch, 0.085 inch, 0.090 inch, 0.095 inch, or 0.100 inch. The second post offset $O_{P2}$ is dependent on the size and cross-sectional shape of the grip 10. The second post offset $O_{P2}$ corresponds to the second aperture offset $O_{A2}$, as described in more detail below. Together, the second aperture offset $O_{A2}$ and the second post offset $O_{P2}$ help position the sensor housing 100 within the grip perimeter 17. As discussed above, the positioning of the post 160 relative to the base 150 helps position the sensor housing in the desired, non-obtrusive location on the grip 10.

Another key feature of the post design is the geometry of the post's threads 162. Referring to FIGS. 8 and 9, the threads 162 comprise a plurality of thickened regions 164 formed along the post axis 50. The thickened regions 164 further stabilize the connection between the post 160 and the grip 10 by preventing the post 160 from being removed from the grip aperture 18 once installed.

As discussed above, the base 150 provides several functions to the sensor housing 100. Namely, the disk 152 provides floor to the sensor 20, and the post 160 forms a connection with the grip aperture 18 to secure the sensor housing 100 to the grip 10. Various features of the base 150 can be configured to provide a non-obtrusive sensor housing 100. For example, in some embodiments, the post 160 can be positioned to ensure that the sensor housing 100 remains within the grip perimeter 17. Additionally, each feature of the base 150 can be designed to reduce the structural weight of the sensor housing 100 to ensure the sensor housing 100 does not have a significant effect on the center of gravity of the golf club. While the base 150 provides lower support to the sensor 20, the cover 120 provides a sheath to the upper portion of the sensor 20.

Figure 13:
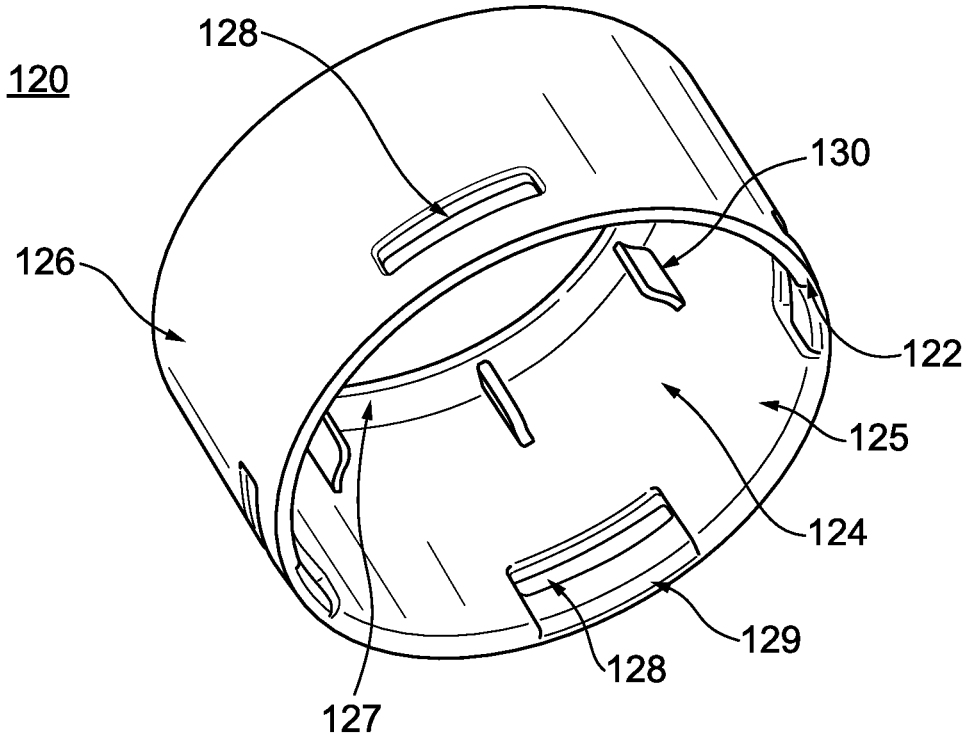
FIG. 13 illustrates a bottom perspective view of the sensor housing cover of FIG. 1.
Figure 14:
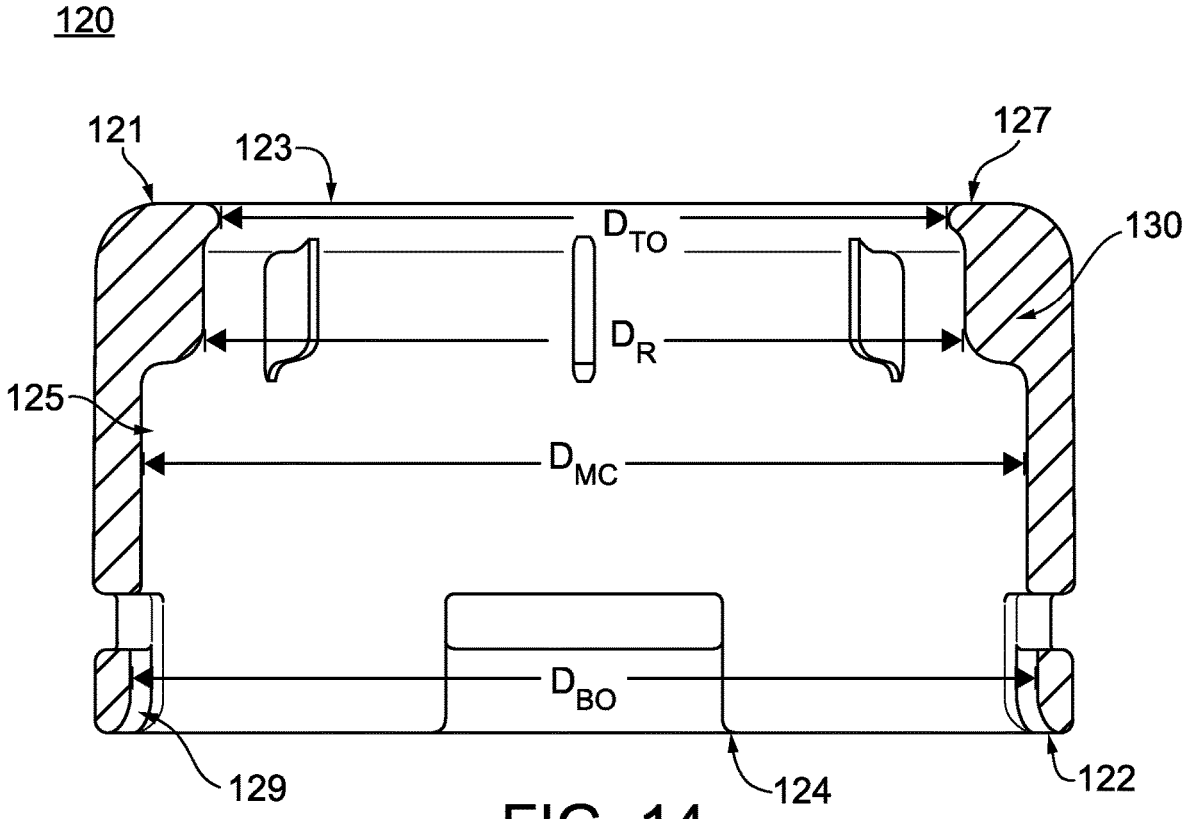
FIG. 14 illustrates a cross-sectional view of the sensor housing cover of FIG. 1.

Referring to FIGS. 12-14, the cover 120 comprises a hollow cylinder configured to encapsulate the sensor 20 and couple with the base 150. In many embodiments, the cover 120 comprises a single, one-piece construction. The cover 120 comprises a top edge 121, a bottom edge 122, an inner surface 125, and an outer surface 126. As discussed above, the inner surface 125 helps to define the sensor cavity 102. Referring to FIG. 3, the sensor cavity 102 is defined circumferentially by the inner surface 125, and the disk 152 (of the base 150) provides a floor to the sensor cavity 102. The sensor cavity 102 extends from the top edge 121 to the disk top surface 154. In many embodiments, the sensor cavity 102 does not extend to the bottom edge 122.

The bottom edge 122 is located near the grip butt end 12, as illustrated in FIG. 1. The cover 120 defines a bottom opening 124 near the bottom edge 122 configured to receive the base 150. Therefore, the bottom opening 124 is sized to accommodate the disk 152, as discussed in more detail below. The cover 120 further comprises a rim 127 near the top edge 121 that extends inwardly, as illustrated in FIGS. 12 and 13. The cover 120 further defines a top opening 123 near the top edge 121, and the rim 127 forms an entire uninterrupted perimeter of the top opening 123. The sensor 20 is exposed to an exterior through the top opening 123, and the rim 127 retains the sensor 20 within the sensor cavity 102. FIG. 2 illustrates a top-down view of the grip 10, where the sensor 20 is visible when viewing the grip butt end 12 in a plane orthogonal to the longitudinal axis 40.

The cover 120 provides a sheath for retaining the sensor 20 within the sensor cavity 102 and is configured to receive the base 150 to encapsulate the sensor 20. To receive the base 150, the cover 120 further defines a plurality of windows 128 (hereafter referred to as "windows") near the bottom edge 122. Referring to FIGS. 12 and 13, the windows 128 each create an opening in the cover 120 that extends from the inner surface 125 through the outer surface 126. The windows 128 receive the tabs 158 of the base 150, thereby securing the cover 120 to the base 150. The windows 128 are portions of the cover 120, that are devoid of material, thereby reducing the structural mass of the sensor housing 100. As discussed above, the reduction in structural mass helps to provide a non-obtrusive sensor housing 100 that does not significantly affect the center of gravity of the club head.

In many embodiments, the windows 128 comprise a shape such as rectangular or trapezoidal in a cross-sectional or side view. For example, FIG. 14 illustrates one embodiment of the windows 128 in which the windows 128 define a rectangular shape in a cross-sectional view. The windows 128 comprise a geometry that corresponds to the geometry of the plurality of tabs 158. In many embodiments, the windows 128 are formed such that they prevent the base 150 from being removed from the cover 120. The windows 128 thereby facilitate a tight and non-removable connection between the cover 120 and the base 150. In some embodiments, each window 128 comprises the same shape as the adjacent windows 128, as illustrated in FIG. 12. In other embodiments, each window 128 comprises a different shape than the adjacent windows 128. In many embodiments, the windows 128 can comprise a shape similar to that of the corresponding tabs 158 to allow the windows 128 to receive the tabs 158.

The cover 120 can comprise any suitable number of windows 128 to allow the cover 120 to be secured to the base 150. For example, the cover 120 can comprise between 2 to 4 windows, 3 to 6 windows, 4 to 8 windows, or 5 to 10 windows. In some embodiments, the cover 120 can comprise 1 window, 2 windows, 3 windows, 4 windows, 5 windows, 6 windows, 7 windows, 8 windows, 9 windows, or 10 or more windows. FIGS. 12 and 13 illustrate one embodiment of the cover 120, wherein the cover 120 comprises 4 windows 128. In most embodiments, the number of windows 128 corresponds to the number of tabs 158 located on the base 150. In some embodiments, the windows 128 are equally spaced apart from one another. In other embodiments, the windows 128 are not equally spaced apart from one another. The windows 128 are located around the cover 120 near the bottom edge 122 to allow the disk 152 (and the base 150) to be received by the cover 120. Therefore, the sizing, shaping, and positioning of the windows 128 are selected to ensure that the tabs 158 can be secured within the windows 128 of the cover 120.

The cover 120 can be configured to permanently receive the base 150. As discussed above, the shaping and positioning of the windows 128 allows the cover to easily receive the base 150. In some embodiments, the cover 120 can be tapered, rounded, chamfered, or otherwise reshaped near the bottom opening 124 to concentrate flexing near the bottom edge 122 when the base 150 is received by the cover 120. In certain embodiments, these features can help the cover 120 to flex and receive the base 150.

Referring to FIGS. 13 and 14, in some embodiments, the cover 120 can further comprise thinned regions 129 located below each of the windows 128. The thinned regions 129 can facilitate the interaction between the cover 120 and the base 150 by allowing the cover 120 to flex as the tabs 158 are received by the windows 128. As discussed above, the tabs 158 can be chamfered, allowing them to flex as they interact with the thinned regions 129. In many embodiments, the cover 120 and the base 150 can both flex slightly as they interact. In some embodiments, the tabs 158 can extend perpendicularly through the windows 128. Thereafter, a tight and non-removable connection is formed between the tabs 158 and the windows 128. The windows 128 are sized and positioned to correspond to the tabs 158 to facilitate the connection therebetween.

In some embodiments, the windows 128 are located at an offset from the cover bottom edge 122. Therefore, the base 150 is situated above the cover bottom edge 122, and a portion of the cover bottom edge 122 extends past the base 150. Referring to FIG. 4, a lower cavity 104 is defined by the disk bottom surface 156 and the cover inner surface 125. The lower cavity 104 extends from beneath the base 150 to the cover bottom edge 122. The lower cavity 104 is proximate the grip butt end 12. Referring to FIG. 1, the lower cavity 104 and the tapered bottom edge 122 allow the sensor housing 100 to be situated lower on grip 10. The lower cavity 104 receives a portion of the grip butt end 12, and the cover bottom edge 122 compresses the grip 10. The lower cavity 104 allows the sensor housing 100 to sit lower, thereby creating a less-obtrusive sensor housing 100. Referring to FIG. 4, a lower portion of the cover 120 located below the plurality of windows 128 is solid or devoid of any windows 128. Therefore, the solid lower portion (of the cover 120) and the tapered bottom edge 122 help seal the sensor housing 100 to the grip 10, thereby preventing any debris from entering the lower cavity 104. Following installation, the lower cavity 104 is substantially enclosed between the disk bottom surface 156, the cover inner surface 125, and the grip 10. The dimensions of the lower cavity 104 can further assist in providing a non-obtrusive sensor housing 100.

The lower cavity 104 defines a depth measured vertically along the longitudinal axis 40 between the disk bottom surface 156 and the cover bottom edge 122. In many embodiments, the lower cavity depth is between 0.005 inch to 0.10 inch. In some embodiments, the lower cavity depth is between 0.005 inch to 0.075 inch, 0.05 inch to 0.065 inch, or 0.075 inch to 0.10 inch. In some embodiments, the lower cavity depth is approximately 0.005 inch, 0.0075 inch, 0.010 inch, 0.0125 inch, 0.0150 inch, 0.0175 inch, 0.020 inch, 0.025 inch, 0.0275 inch, 0.030 inch, 0.0325 inch, 0.0350 inch, 0.0375 inch, 0.0400 inch, 0.0425 inch, 0.0450 inch, 0.0475 inch, 0.05 inch, 0.055 inch, 0.06 inch, 0.065 inch, 0.07 inch, 0.075 inch, 0.08 inch, 0.085 inch, 0.09 inch, 0.095 inch, or 0.10 inch. In one exemplary embodiment, the lower cavity depth is 0.06 inch. In some embodiments, the depth is substantially constant. In other embodiments, and where the base 150 has a variable thickness $t_D$, the depth can be correspondingly variable. The lower cavity depth can be large enough to allow the sensor housing 100 to be firmly pressed onto the grip 10 such that at least a portion the butt end 12 is retained within the lower cavity 104.

As discussed above, the lower cavity 104 receives a portion of the grip 12, as illustrated in FIG. 1. The butt end 12 of the grip 10 defines a surface that is adjacent to the disk bottom surface 156. The tight connection between the sensor housing 100 and the grip 10 causes a portion of the disk bottom surface 156 to contact said surface of the butt end 12. The contact between these adjacent surfaces can be characterized as a percentage of the total surface area of the disk bottom surface 156 that contacts the surface of the butt end 12. In many embodiments, at least 25% of the disk bottom surface 156 is in contact with the surface of the butt end 12. In some embodiments, between 25%-35%, 30%-50%, 45%-65%, 50%-75%, 60%-85%, 70%-95%, or 80%-100% of the disk bottom surface 156 is in contact with the surface of the butt end 12. In some embodiments, at least 25%, 30%, 35%, 40%, 45%, 50%, 55%, 60%, 65%, 70%, 75%, 80%, 85%, 90%, 95%, or 100% of the disk bottom surface 156 is in contact with the surface of the butt end 12. The amount of contact between these surfaces determines how flush the sensor housing 100 is relative to the grip butt end 12. Therefore, a higher percentage of contact is desirable to ensure that the sensor housing 100 sits in a lower, less-obtrusive position. Further, a higher percentage of contact helps to stabilize the sensor housing 100 as more of the surface area of the disk 152 is supported by the surface of the butt end 12.

As discussed above, the cover 120 provides a sheath for protecting and retaining the sensor 20 within the sensor cavity 102. Referring to FIGS. 12 and 13, the cover 120 can further comprise a plurality of ribs 130 (hereafter referred to as "ribs") that hold the sensor 20 into the cavity. The ribs 130 project from the cover inner surface 125 into the sensor cavity 102 and contact a top surface of the sensor 20. The ribs 130 are positioned near the top edge 121, or near the rim 127.

In many embodiments, the ribs 130 comprise a shape such as rectangular or trapezoidal. For example, FIG. 13 illustrates one embodiment of the ribs 130 in which the ribs 130 are substantially rectangular. In some embodiments, each rib 130 comprises the same shape as the adjacent ribs 130, as illustrated in FIG. 13. In other embodiments, each rib 130 comprises a different shape than the adjacent ribs 130. In many embodiments, the ribs 130 comprise a geometry that corresponds to the geometry of the sensor 20. For example, FIG. 1 illustrates a cross-sectional view of the sensor, in which the sensor 20 comprises a variable diameter. In many embodiments, the ribs 130 are formed such that they prevent the sensor 20 from moving within the sensor cavity 102. The ribs 130 provide a lightweight mechanism for securing the sensor 20. Therefore, the ribs 130 help provide a non-obtrusive sensor housing 100 by not significantly increasing the structural mass of the sensor housing 100.

The cover 120 can comprise any suitable number of ribs 130 to adequately secure the sensor 20 within the sensor cavity 102. For example, the cover 120 can comprise between 2 to 4 ribs, 3 to 6 ribs, 4 to 8 ribs, or 5 to 10 ribs. In some embodiments, the cover 120 can comprise 1 rib, 2 ribs, 3 ribs, 4 ribs, 5 ribs, 6 ribs, 7 ribs, 8 ribs, 9 ribs, or 10 or more ribs. In some embodiments, the ribs 130 are equally spaced apart from one another. In other embodiments, the ribs 130 are not equally spaced apart from one another. The ribs 130 are located around the cover 120 near the top edge 121 to secure the sensor 20 within the sensor cavity 102. Therefore, the sizing, shaping, and positioning of the ribs 130 are selected to ensure that the sensor 20 is secure within the sensor cavity 102. In some embodiments, the cover 120 can comprise additional features to assist in firmly securing the sensor 20 within the sensor cavity 102.

In addition to the support provided by the ribs 130, the variable inner diameter of the cover 120 can further secure the sensor 20 within the sensor cavity 102. Referring to FIG. 14, the cover diameter is variable from the top edge 121 to the bottom edge 122 to firmly secure the sensor 20, while being able to accept the base 150. In many embodiments, the sensor 20 comprises a variable diameter. In these embodiments, the diameter of the cover 120 diameter can vary to accommodate the sensor 20, as illustrated in FIG. 1. The diameter is smaller near the top opening 123 to hold the sensor 20 into place. The diameter gradually increases towards the bottom opening 124, where it is large enough to receive the base 150. The diameters described herein are measured in a plane orthogonal to the longitudinal axis 40.

Referring to FIG. 14, the top opening 123 defines a top opening diameter Dro measured across the top opening 123. In many embodiments, the top opening diameter Dro is between 0.50 inch and 0.75 inch. In some embodiments, the top opening diameter Dro is between 0.50 inch to 0.60 inch, 0.55 inch to 0.75 inch, or 0.65 inch to 0.70 inch. In some embodiments, the top opening diameter Dro is approximately 0.50 inch, 0.51 inch, 0.52 inch, 0.53 inch, 0.54 inch, 0.55 inch, 0.56 inch, 0.57 inch, 0.58 inch, 0.59 in, 0.60 inch, 0.61 inch, 0.62 inch, 0.63 inch, 0.64 inch, 0.65 inch, 0.66 inch, 0.67 inch, 0.68 inch, 0.69 in, 0.70 inch, 0.71 inch, 0.72 inch, 0.73 inch, 0.74 inch, or 0.75 inch. In one exemplary embodiment, the top opening diameter Dro is 0.69 inch. The top opening diameter Dro is the smallest to retain the sensor 20 into the sensor cavity 102.

Referring again to FIG. 14, the ribs 130 defines a rib diameter $D_R$ measured through a center of the cover 120 between opposing ribs 130. In many embodiments, the rib diameter $D_R$ is between 0.50 inch and 0.75 inch. In some embodiments, the rib diameter $D_R$ is between 0.50 inch to 0.60 inch, 0.55 inch to 0.75 inch, or 0.65 inch to 0.70 inch. In one exemplary embodiment, the rib diameter $D_R$ is 0.70 inch. In some embodiments, the rib diameter $D_R$ is approximately 0.50 inch, 0.51 inch, 0.52 inch, 0.53 inch, 0.54 inch, 0.55 inch, 0.56 inch, 0.57 inch, 0.58 inch, 0.59 in, 0.60 inch, 0.61 inch, 0.62 inch, 0.63 inch, 0.64 inch, 0.65 inch, 0.66 inch, 0.67 inch, 0.68 inch, 0.69 in, 0.70 inch, 0.71 inch, 0.72 inch, 0.73 inch, 0.74 inch, or 0.75 inch. The rib diameter $D_R$ is slightly smaller than the top opening diameter Dro to accommodate the stepped geometry of the sensor 20.

Referring again to FIG. 14, the sensor cavity 102 defines a main cavity diameter $D_{MC}$ measured through a center of the cover 120 within a main or central portion of the sensor cavity 102. In many embodiments, the main cavity diameter $D_{MC}$ is between 0.70 inch and 0.90 inch. In some embodiments, the main cavity diameter $D_{MC}$ is between 0.70 inch to 0.80 inch, 0.75 inch to 0.90 inch, or 0.80 inch to 0.90 inch. In some embodiments, the rib diameter $D_R$ is approximately 0.70 inch, 0.71 inch, 0.72 inch, 0.73 inch, 0.74 inch, 0.75 inch, 0.76 inch, 0.77 inch, 0.78 inch, 0.79 in, 0.80 inch, 0.81 inch, 0.82 inch, 0.83 inch, 0.84 inch, 0.85 inch, 0.86 inch, 0.87 inch, 0.88 inch, 0.89 in, or 0.90 in. In one exemplary embodiment, the main cavity diameter $D_{MC}$ is 0.75 inch. The main cavity diameter $D_{MC}$ can be larger than the top opening diameter Dro and the rib diameter $D_R$ to accommodate the widest portion of the sensor 20.

Referring again to FIG. 14, the bottom opening 124 defines a bottom opening diameter $D_{BO}$ measured across the bottom opening 124. In many embodiments, the bottom opening diameter $D_{BO}$ is between 0.70 inch and 0.90 inch. In some embodiments, the bottom opening diameter $D_{BO}$ is between 0.70 inch to 0.80 inch, 0.75 inch to 0.90 inch, or 0.80 inch to 0.90 inch. In some embodiments, the bottom opening diameter $D_{BO}$ is approximately 0.70 inch, 0.71 inch, 0.72 inch, 0.73 inch, 0.74 inch, 0.75 inch, 0.76 inch, 0.77 inch, 0.78 inch, 0.79 in, 0.80 inch, 0.81 inch, 0.82 inch, 0.83 inch, 0.84 inch, 0.85 inch, 0.86 inch, 0.87 inch, 0.88 inch, 0.89 in, or 0.90 in. In one exemplary embodiment, the bottom opening diameter $D_{BO}$ is 0.80 inch. In some embodiments, the bottom opening diameter $D_{BO}$ can vary to depending on the presence of features near the bottom opening 124, such as thinned regions or notches. For example, FIG. 14 illustrates one embodiment of the cover 120, where the bottom opening diameter $D_{BO}$ is greater near the portions comprising thinned regions 129. In many embodiments, the bottom opening diameter $D_{BO}$ corresponds to the diameter of the disk 152 to allow the disk 152 to be received within the bottom opening 124.

The cover 120 further comprises an outer diameter measured across the cover 120 from the outer surface 126 (not shown). In many embodiments, the outer diameter is between 0.75 inch and 1.00 inch. In some embodiments, the outer diameter is between 0.75 inch to 0.90 inch, 0.85 inch to 0.90 inch, or 0.85 inch to 1.00 inch. In some embodiments, the outer diameter is approximately 0.75 inch, 0.76 inch, 0.77 inch, 0.78 inch, 0.79 in, 0.80 inch, 0.81 inch, 0.82 inch, 0.83 inch, 0.84 inch, 0.85 inch, 0.86 inch, 0.87 inch, 0.88 inch, 0.89 in, 0.90 in, 0.91 inch, 0.92 inch, 0.93 inch, 0.94 inch, 0.95 inch, 0.96 inch, 0.97 inch, 0.98 inch, 0.99 in, or 0.100 inch. In one exemplary embodiment, the outer diameter is 0.89 inch. The outer diameter is large enough to provide sufficient thickness and durability to the sensor housing 100, while remaining within the grip perimeter 17. Further, all of the aforementioned diameters are small enough to ensure that the sensor housing 100 is small enough to remain within the grip perimeter 17.

The cover 120 further comprises a height measured along the longitudinal axis 40 from the top edge 121 to the bottom edge 122 (not shown). In many embodiments, the height is between 0.30 inch to 0.50 inch. In some embodiments, the height is between 0.30 inch to 0.45 inch, 0.35 inch to 0.50 inch, or 0.40 inch to 0.50 inch. In some embodiments, the height is approximately 0.30 inch, 0.31 inch, 0.32 inch, 0.33 inch, 0.34 inch, 0.35 inch, 0.36 inch, 0.37 inch, 0.38 inch, 0.39 in, 0.40 in, 0.41 inch, 0.42 inch, 0.33 inch, 0.44 inch, 0.45 inch, 0.46 inch, 0.47 inch, 0.48 inch, 0.49 in, or 0.50 inch. In one exemplary embodiment, the height is 0.48 inch. The height can be selected to accommodate the sensor 20.

The cover 120 further comprises a thickness measured from the inner surface 125 to the outer surface 126. In many embodiments, the thickness is between 0.01 inch to 0.25 inch. In some embodiments, the thickness is between 0.01 inch to 0.15 inch, 0.10 inch to 0.20 inch, or 0.15 inch to 0.25 inch. In some embodiments, the thickness is approximately 0.010 inch, 0.015 inch, 0.020 inch, 0.025 inch, 0.030 inch, 0.035 inch, 0.040 inch, 0.045 inch, 0.050 inch, 0.055 inch, 0.060 inch, 0.065 inch, 0.070 inch, 0.075 inch, 0.080 inch, 0.085 inch, 0.090 inch, 0.095 inch, 0.10 inch, 0.11 inch, 0.12 inch, 0.13 inch, 0.14 inch, 0.15 inch, 0.16 inch, 0.17 inch, 0.18 inch, 0.19 in, 0.20 inch, 0.21 inch, 0.22 inch, 0.23 inch, 0.24 inch, or 0.25 inch. The thickness is large enough to provide sufficient durability to the sensor housing 100, while remaining within the grip perimeter 17.

As discussed above, the cover 120 provides several functions to the sensor housing 100. Namely, the cover 120 provides a sheath to the sensor 20 and further provides a structure for receiving the base 150. Various features of the cover 120 can be configured to provide a non-obtrusive sensor housing 100. For example, in some embodiments, the presence of windows 128 or ribs 130 can reduce the structural mass of the sensor housing 100, thereby ensuring the sensor housing 100 does not have a significant effect on the center of gravity of the golf club.

As discussed above, various features of the sensor housing 100 can be designed to provide a lightweight sensor housing. In many embodiments, the sensor housing 100 comprises a mass between 5.0 grams to 7.0 grams. In some embodiments, the mass is between 5.0 grams to 5.3 grams, 5.2 grams to 5.7 grams, 5.6 grams to 6.2 grams, 5.8 grams to 6.4 grams, 6.0 grams to 6.3 grams, 6.2 grams to 6.5 grams, 6.3 grams to 6.7 grams, or 6.5 grams to 7.0 grams. In some embodiment, the mass is approximately 5.0 grams, 5.1 grams, 5.2 grams, 5.3 grams, 5.4 grams, 5.5 grams, 5.6 grams, 5.7 grams, 5.8 grams, 5.9 grams, 6.0 grams, 6.1 grams, 6.2 grams, 6.3 grams, 6.4 grams, 6.5 grams, 6.6 grams, 6.7 grams, 6.8 grams, 6.9 grams, 7.0 grams. In one exemplary embodiment, the mass of the sensor housing 100 is approximately 6.2 grams. The sensor housing 100 can be assembled without the use of an adhesive material to secure the sensor 20. The absence of an adhesive material further reduces the structural weight of the sensor housing 100.

In many embodiments, the base 150 and the cover 120 can be formed from one or more polymeric materials. The base 150 and the cover 120 can be formed from the same material, or different materials. In some embodiments, the one or more polymeric materials can be thermoplastic materials. For example, the one or more polymeric materials can be Polyamide 66 (PA66). In some embodiments, the one or more polymeric materials can have a Shore A hardness of between 50 A and 70 A. In some embodiments, the one or more polymeric materials can have a Shore D hardness of between 25D and 50D.

I. Sensor Housing 200

Figure 15:
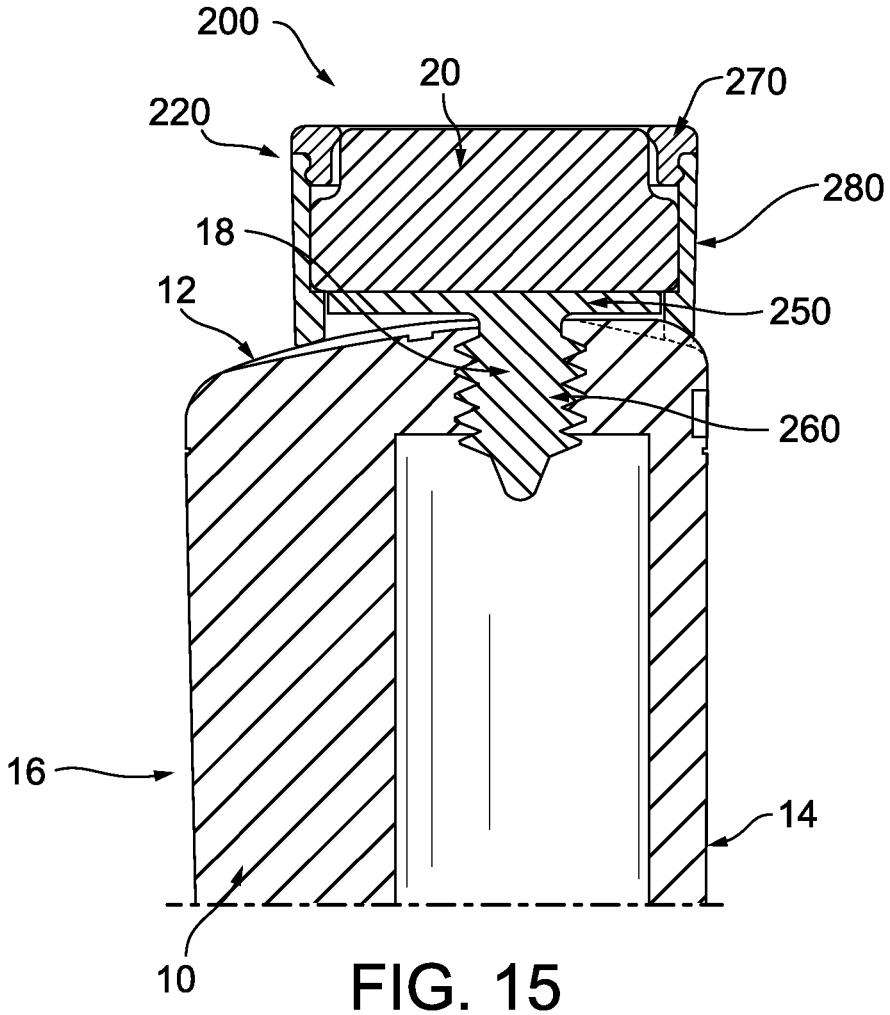
FIG. 15 illustrates a cross-sectional view of a golf club grip comprising a sensor housing, according to a second embodiment.

FIGS. 15-18 illustrate a second embodiment of the sensor housing described herein. The sensor housing 200 can be configured to couple with the grip, similar to the sensor housing 100. The sensor housing 200 achieves a non-obtrusive configuration by not extending beyond the grip perimeter 17, as illustrated in FIG. 15. The sensor housing 200 comprises a base 250 and a cover 220 that utilize a different coupling mechanism than the sensor housing 100. The cover 220 does not include windows, and the base does not include tabs. Instead, the cover 220 comprises two-piece construction including a rim 270 and a skirt 280. Rather than utilizing the window and tab system of the sensor housing 100, the rim 270 secures the components together, as discussed in more detail below.

Referring to FIG. 18, the base 250 comprises a disk 252 and a post 260, wherein the post is similar to the previously described post 160. In comparison to the disk 152, the disk 252 is devoid of tabs. Instead, the base 250 defines a plurality of indented portions 290, where the disk perimeter 257 is recessed inwards towards a center of the disk 252. As discussed in more detail below, the indented portions 290 help facilitate the connection between the base 250 and the cover 220 by receiving a plurality of notches 286 located on the cover 220.

In many embodiments, the indented portions 290 comprise a shape such as rectangular or trapezoidal in a cross-sectional or side view. For example, FIG. 18 illustrates one embodiment of the indented portions 290 in which the indented portions 290 define a rectangular shape. The indented portions 290 can be configured to allow the notches 286 to glide into place when received by the cover 220. In some embodiments, each indented portion 290 comprises the same shape as the indented portions 290, as illustrated in FIG. 18. In other embodiments, indented portion 290 comprises a different shape than the indented portions 290. In many embodiments, the indented portion 290 can comprise a shape similar to that of the corresponding notch 286 to allow the indented portions 290 to receive the notches 286.

The disk 252 can comprise any suitable number of indented portions 290 to allow the cover 220 to be secured to the base 250. For example, the disk 252 can comprise between 2 to 4 indented portions, 3 to 6 indented portions, 4 to 8 indented portions, or 5 to 10 indented portions. In some embodiments, the disk 252 can comprise 1 indented portion, 2 indented portions, 3 indented portions, 4 indented portions, 5 indented portions, 6 indented portions, 7 indented portions, 8 indented portions, 9 indented portions, or 10 or more indented portions. In some embodiments, the indented portions 290 are equally spaced apart from one another. In other embodiments, the indented portions 290 are not equally spaced apart from one another. The indented portions 290 are located around the disk perimeter 257 to allow the disk 252 (and the base 250) to be received by the cover 220. Therefore, the sizing, shaping and positioning of the indented portions 290 are selected to ensure that the notches 286 of the cover 220 can be secured within the indented portions 290. In some embodiments, the shaping and dimensions of the indented portions 290 alter the dimensions of the disk 252.

As discussed above, the base 250 is similar to the base 150. The disk 252 is similar to the disk 152, but for the lack of tabs 158. The disk 252 comprises a diameter similar to the diameter of the disk 152, and a thickness $t_D$ similar to the thickness $t_D$ of the disk 152. Further, the post 260 is similar to the post 160. The post 260 can be located at first post offset $O_{P1}$ and/or a second post offset $O_{P2}$ similar to those of the post 160. In some embodiments, the threads 262 comprise thickened portions 264 similar to those of the post 160. Similar to the sensor housing 100, the sensor housing 200 minimized the structural weight of each of the features helps provide a non-obtrusive sensor housing that does not significantly affect the center of gravity of the golf club. While the base 250 provides lower support to the sensor 20, the cover 220 provides a sheath to the upper portion of the sensor 20.

Figure 16:
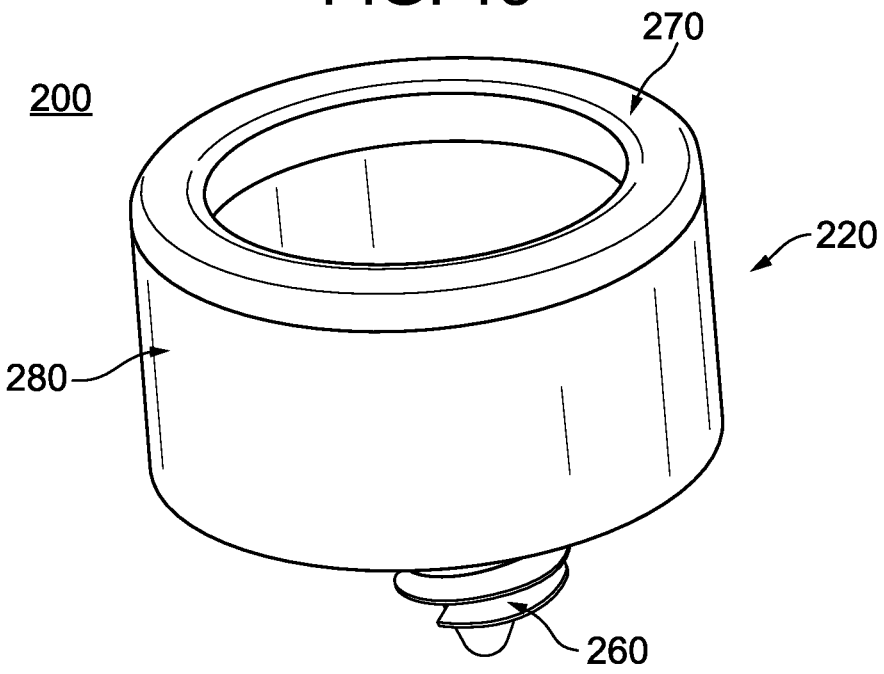
FIG. 16 illustrates a perspective view of the sensor housing of FIG. 15.
Figure 17:
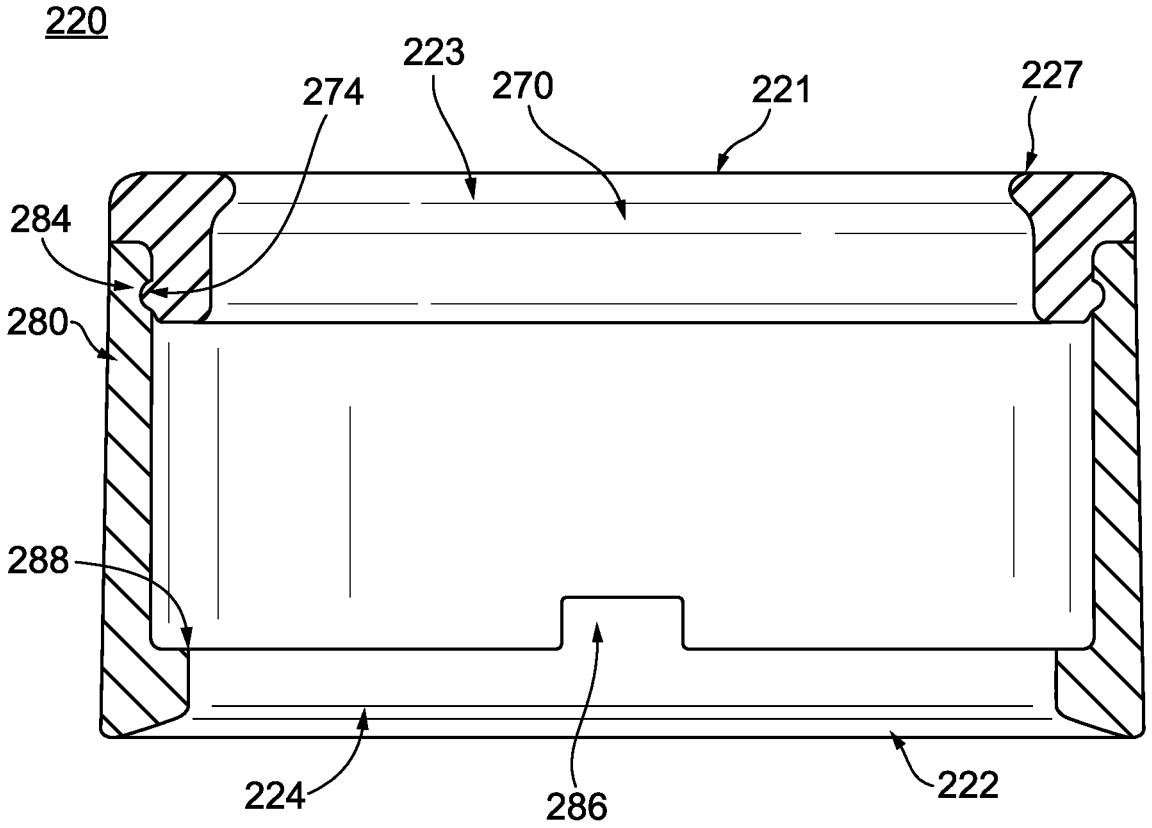
FIG. 17 illustrates a cross-sectional view of the sensor housing cover of FIG. 15.

Referring to FIGS. 16 and 17, the cover 220 is shaped substantially similarly to the cover 120. However, the cover 220 comprises a two-piece construction including a rim 270 and a skirt 280. The skirt 280 is a peripheral portion of the cover 220, and the rim is an upper portion of the cover 220. The skirt 280 can comprise a plurality of notches 286 that correspond to the indented portions 290 located on the base 250. To assemble the sensor housing 200, the base 250 can first be positioned within the skirt 280, the sensor can then be placed in the sensor cavity 202, and finally, the rim 270 can be secured over the sensor 20 and snapped onto the skirt 280.

The skirt 280 provides a mechanism for receiving the base 250 as well as the rim 270. Referring again to FIG. 17, the skirt 280 can comprise a plurality of notches 286 near the bottom edge 222. The notches 286 can facilitate the interaction between the cover 120 and the base 150 by providing support regions that correspond to the indented portions 290 located on the base 250. Thereafter, a tight and non-removable connection is formed between the notches 286 and the indented portions 290. The notches 286 are sized and positioned to correspond to the indented portions 290 to facilitate the connection therebetween.

The skirt 280 can comprise any suitable number of notches 286 to allow the skirt 280 to receive the base 250. For example, the skirt 280 can comprise between 2 to 4 notches, 3 to 6 notches, 4 to 8 notches, or 5 to 10 notches. In some embodiments, the skirt 280 can comprise 1 notch, 2 notches, 3 notches, 4 notches, 5 notches, 6 notches, 7 notches, 8 notches, 9 notches, or 10 or more notches. In some embodiments, the notches 286 are equally spaced apart from one another. In other embodiments, the notches 286 are not equally spaced apart from one another. The notches 286 are located around the skirt 280 near the bottom edge 222 to allow the base 250 to be received by the skirt 280. Therefore, the sizing, shaping and positioning of the notches 286 are selected to ensure that the indented portions 290 can be secured within the notches 286.

Referring to FIG. 17, the skirt 280 can define a circumferential recess 284 near the top edge 221. The recess 284 can receive a projection 274 located on the rim 270, to secure the rim 270 to the skirt 280. FIG. 17 illustrates one embodiment, where the sensor housing 200 comprises a single, continuous recess 284. However, in other embodiments, the sensor housing 200 can comprise a plurality of independent recesses 284 that correspond to the features located on the rim 270. In many embodiments, the recess 284 is formed such that it prevents the rim 270 from being removed from the skirt 280. In many embodiments, the recesses 284 can comprise a shape similar to that of the projections 274 to allow the recesses 284 to receive the projections 274.

The skirt 280 can comprise any suitable number of recesses 284 to allow the skirt 280 to be secured to the rim 270. For example, the skirt 280 can comprise between 2 to 4 recess, 3 to 6 recess, 4 to 8 recess, or 5 to 10 recesses. In some embodiments, the skirt 280 can comprise 1 recess, 2 recesses, 3 recesses, 4 recesses, 5 recesses, 6 recesses, 7 recesses, 8 recesses, 9 recesses, or 10 or more recesses. In some embodiments, the recesses 284 are equally spaced apart from one another. In other embodiments, the recesses 284 are not equally spaced apart from one another. The recess 284 is located around the skirt 280 near the top edge 221 to allow the rim 270 to be received by the skirt 280. Therefore, the sizing, shaping and positioning of the recesses 284 are selected to ensure that the projections 274 can be secured within the recesses 284. As discussed above, the skirt 280 provides a means to receive both the base 250, and the rim 270.

Referring to FIGS. 16 and 17, the rim 270 defines an upper portion of the cover 220. The rim 270 can snap into the skirt 280 to secure the sensor into the sensor cavity 202. In many embodiments, the skirt 280 can comprise a circumferential projection 274, to secure the rim 270 to the skirt 280. FIG. 17 illustrates one embodiment, where the rim 270 comprises a single, continuous projection 274. However, in other embodiments, the rim 270 can comprise a plurality of independent projections 274 that correspond to the plurality of recesses 284 located on the skirt 280. In many embodiments, the projections 274 can comprise a shape similar to that of the recesses 284 to allow the recesses 284 to receive the projections 274.

The rim 270 can comprise any suitable number of projections 274 to allow the skirt 280 to be secured to the rim 270. For example, the rim 270 can comprise between 2 to 4 projections, 3 to 6 projections, 4 to 8 projections, or 5 to 10 projections. In some embodiments, the skirt 280 can comprise 1 projection, 2 projections, 3 projections, 4 projections, 5 projections, 6 projections, 7 projections, 8 projections, 9 projections, or 10 or more projections. In some embodiments, the projections 274 are equally spaced apart from one another. In other embodiments, the projections 274 are not equally spaced apart from one another. The projections 274 are located around the rim 270 to allow the rim 270 to be received by the skirt 280. Therefore, the sizing, shaping and positioning of the projections 274 are selected to ensure that the projections 274 can be secured within the recesses 284.

As discussed above, the sensor housing 100 is enclosed via the aforementioned tab and window system. The sensor housing 200, however, is enclosed via the connection between the rim 270 and the skirt 280. However, the sensor housing 200 is similar to the sensor housing 100, but for the difference in the coupling mechanism. Specifically, the general shaping, dimensions, and materials of the sensor housing 200 are similar to those of the sensor housing 100.

The sensor housing described herein provides advantages that are an improvement over the art. The sensor housing is non-obtrusive and easy to manufacture. The sensor housing remains within the grip footprint, includes mass reducing features, and reduces the length added to the grip. Therefore, the sensor housing minimizes the effects on CG. The sensor housing can be used on grips comprising asymmetrical geometries. The sensor housing provides a secure structure for the sensor. The sensor housing also provides manufacturing benefits. The sensor housing can be formed from multiple materials and does not require an adhesive to secure the sensor. The exclusion of an adhesive material further reduces the structural weight of the sensor housing. The sensor housing is multi-purpose and can be used with various sports items such as golf clubs, bats, or rackets.

METHOD

The method of manufacturing the golf club described herein comprising (1) providing a grip; (2) forming an aperture in the grip; (3) forming a cover; (4) forming a base; (5) providing a sensor; (6) placing the cover over the sensor; (7) coupling the base to the cover; and (8) coupling the sensor housing to the grip. In step 2, the aperture can be a threaded aperture formed in the butt end of the grip. The aperture can be positioned at an offset, as described above. In step 3, the cover can comprise a one-piece, or a two-piece construction. The cover can comprise various features to couple with corresponding features located on the base. For example, the cover can comprise a plurality of windows, or a plurality of projections. In step 4, the base can comprise a disk and an integrally formed post extending from a bottom surface of said disk. The base can comprise various features to couple with corresponding features located on the cover. For example, the base can comprise a plurality of tabs or indented portions. In step 7, the base can be received through a lower opening of the cover or inserted through an upper opening of the cover. In some embodiments, the cover and the base can couple via a plurality of corresponding tabs and windows. In step 8, the threaded post is received within the aperture. Further, the sensor housing is received by the grip such that the sensor housing is positioned within the grip perimeter.

Example

Further described herein is a comparison of performance results between multiple sensor housings with different constructions. The results compared the effects that the sizing and shaping of the sensor housings had on user satisfaction. The dimensions, weight, and positioning were varied throughout the sample sensor housings. As discussed above, these variables can determine the how noticeable or awkward the sensor housing feels to the user.

The control sensor housing comprised a three-piece geometry including a cover with a skirt and a rim, and a base. The cover and the base were coupled via a plurality interlocking features. A sensor was secured between the cover and the base with the use of an adhesive material. The base included a disk and a post, where the post was positioned at a center of the disk. This positioning of the post allowed the control sensor housing to overhang or extend beyond the perimeter of the grip. The lower cavity defined a depth of 0.16 inch. The control sensor housing comprised a height of 0.55 inch, an outer diameter of 1.10 inch, and a weight of 7.8 grams.

The exemplary sensor housing was designed as a non-obtrusive sensor housing similar to the sensor housing 100 illustrated in FIGS. 3-6. The exemplary sensor housing comprised a two-piece geometry including a cover, and a base. The cover and the base were coupled via a plurality of corresponding tabs and windows. A sensor was secured between the cover and the base without the use of an adhesive material. The base included a disk and a post, where the post was positioned at a forward offset relative to a center of the disk. This offset allowed the sensor housing to remain within the grip perimeter. In addition, the post included a plurality of thickened regions to better secure the post within the grip aperture. The lower cavity defined a depth of 0.06 inch such that at least 50% of a bottom surface of the disk was in contact with a surface of the grip. The exemplary sensor housing comprised a height of 0.48 inch, an outer diameter of 0.89 inch, and a weight of 6.2 grams.

The performance test measured the overall user satisfaction with the sample sensor housings. Twenty-two users were asked to compare the sensor housings and rate the overall obtrusiveness of each sensor housing. The level of obtrusiveness was determined by several factors including the sensor housing height, the amount of overhang beyond the grip perimeter, and the feel of the sensor housing on the user's hands. The exemplary sensor housing exemplified performance benefits over the control sensor housing, as discussed in further detail below.

The exemplary sensor housing demonstrated improved user satisfaction over the control sensor housing. Specifically, 75% of users indicated that they preferred the exemplary sensor housing to the control sensor housing. The comparison between the two sensor housings exemplified the impact that the sizing and positioning have on creating a less-obtrusive sensor housing. The improved performance of the exemplary sensor housing was attributed to the reduced size and careful positioning within the grip perimeter.

The exemplary sensor housing was designed as a lightweight alternative to the control sensor housing. To reduce mass, the exemplary sensor housing was substantially smaller than the control sensor housing and did not utilize an adhesive material. The exemplary sensor housing was 14% shorter, 18% narrower, and 21% lighter than the control sensor housing. The sensor housing height determined how much the sensor housing protruded beyond the end of the grip. Further, the sensor housing diameter and the amount of overhang determined how much the user noticed the sensor housing near the grip perimeter. The exemplary sensor housing also included an offset post, which positioned the sensor housing within a perimeter of the grip. As a result, difference in sizing and geometry of the exemplary sensor housing provided a less-obtrusive sensor housing that was preferred by most users.

CLAUSES

Clause 1. A golf club comprising: a club head, a shaft, a grip, and a sensor housing, wherein: the grip comprises a tip end proximate the shaft, a butt end opposite the tip end, a front, a rear, and a grip; the butt end of the grip defines a grip surface; the grip defines a grip aperture near the butt end for receiving a portion of the sensor housing; the sensor housing comprises a cover, and a base, wherein: the cover comprises a hollow cylinder having a cover top edge, a cover bottom edge, a cover inner surface, and a cover outer surface; the cover further defines a rim near the cover top edge that extends inward; the rim defines a top opening, and the cover bottom edge defines a bottom opening; the cover further defines a plurality of windows located at an offset from the cover bottom edge, and a plurality of thinned regions below each of the plurality of windows; a lower portion of the cover below the plurality of windows is solid; the base comprises a disk and a post, wherein; the disk comprises a disk top surface, a disk bottom surface, a disk perimeter, and a plurality of tabs; the post extends from the disk bottom surface; the base is received by the cover through the bottom opening, and the plurality of tabs are received by the plurality of windows such that the base is located at an offset from the cover bottom edge; the plurality of tabs extend perpendicularly through the plurality of windows; the cover inner surface and the disk top surface define a sensor cavity for housing a sensor; and the disk bottom surface and the lower portion of the cover define a lower cavity, wherein the lower portion of the cover is solid to form a substantially sealed lower cavity; the butt end of the grip is at least partially received in the lower cavity, and at least 50% of the grip surface is in contact with the disk bottom surface; the post is received by the grip aperture to secure the sensor housing to the grip; and the sensor housing remains within the grip surface and does not overhang a perimeter of the grip.

Clause 2. The golf club of clause 1, wherein at least 75% of the grip surface is in contact with the disk bottom surface.

Clause 3. The golf club of clause 1, wherein the cover defines a height between 0.4 inch to 0.5 inch and an outer diameter between 0.85 inch to 1.00 inch.

Clause 4. The golf club of clause 1, wherein the sensor housing comprises a mass between 5 grams to 7 grams.

Clause 5. The golf club of clause 1, wherein the lower cavity defines a cavity depth between 0.05 inch to 0.065 inch.

Clause 6. The golf club of clause 1, wherein the plurality of windows can be 1 window, 2 windows, 3 windows, 4 windows, 5 windows, 6 windows, 7 windows, 8 windows, 9 windows, or 10 or more windows; and the plurality of windows corresponds to the plurality of tabs.

Clause 7. The golf club of clause 1, wherein the cover further comprises a plurality of ribs, wherein: the plurality of ribs project from the cover inner surface into the sensor cavity; the sensor is pinched between the cover inner surface, the plurality of ribs, and the disk top surface; the plurality of ribs are positioned near the cover top edge; the plurality of ribs retain the sensor in place; and the plurality of ribs can be 1 rib, 2 ribs, 3 ribs, 4 ribs, 5 ribs, 6 ribs, 7 ribs, 8 ribs, 9 ribs, or 10 or more ribs.

Clause 8. The golf club of clause 1, wherein: the top opening defines a top opening diameter between 0.65 inch to 0.70 inch; the bottom opening defines a bottom opening diameter between 0.85 inch to 0.90 inch; and the top opening diameter is smaller than the bottom opening diameter.

Clause 9. The golf club of clause 1, wherein the cover comprises a thickness between 0.01 inch to 0.15 inch.

Clause 10. The golf club of clause 1, wherein the cover is tapered near the cover bottom edge, and the cover is rounded near the cover top edge.

Clause 11. The golf club of clause 1, wherein the post and the disk are integral.

Clause 12. The golf club of clause 1, wherein the disk comprises a thickness between 0.01 inch to 0.15 inch, and further comprises a diameter between 0.75 inch to 0.90 inch.

Clause 13. The golf club of clause 1, wherein the plurality of tabs are parallel to the disk top surface.

Clause 14. The golf club of clause 1, wherein the plurality of tabs can be 1 tab, 2 tabs, 3 tabs, 4 tabs, 5 tabs, 6 tabs, 7 tabs, 8 tabs, 9 tabs, or 10 or more tabs.

Clause 15. The golf club of clause 1, wherein the plurality of tabs can comprise a similar shape to that of an adjacent tab, or a different shape to that of the adjacent tab.

Clause 16. The golf club of clause 1, wherein the plurality of windows comprise a rectangular shape, and the plurality of tabs comprise a rectangular shape.

Clause 17. The golf club of clause 1, wherein the base further comprises a base front side proximate a front side of the grip, and a base rear side proximate a rear side of the grip, and the post is located closer to the base front side.

Clause 18. The golf club of clause 1, wherein the post is centered on the disk bottom surface in a heel to toe direction.

Clause 19. The golf club of clause 1, wherein the post is threaded.

Clause 20. The golf club of clause 1, wherein the cover and the base are not removable once assembled.

Clause 21. A method of manufacturing a golf club comprising: providing a club head, a shaft, a grip, and a sensor; forming a grip aperture near a butt end of the grip; forming a sensor housing comprising a cover and base, wherein: the cover comprises a plurality of windows; the base comprises a plurality of tabs and a post; placing the cover over a sensor; coupling the base to the cover where the plurality of tabs and the plurality of windows to secure the base to the cover; and inserting the post into the grip aperture to secure the sensor housing to the grip.

The invention claimed is:

1. A golf club comprising:

a club head, a shaft, a grip, and a sensor housing, wherein:

the grip comprises a tip end proximate the shaft, a butt end opposite the tip end, a front, and a rear;

the grip defines a longitudinal axis extending from a geometric center of the butt end to a geometric center of the tip end;

the butt end of the grip defines a grip surface;

the grip defines a grip aperture near the butt end for receiving a portion of the sensor housing;

the sensor housing comprises a cover, and a base, wherein:

the cover comprises a hollow cylinder having a cover top edge, a cover bottom edge, a cover inner surface, and a cover outer surface;

the cover defines a rim near the cover top edge;

the rim extends inwardly perpendicular to the longitudinal axis and forms an entire uninterrupted perimeter of a top opening, and the cover bottom edge defines a bottom opening;

the cover further defines a plurality of windows located at an offset from the cover bottom edge, and a plurality of thinned regions below each of the plurality of windows;

a lower portion of the cover below the plurality of windows is solid;

the base comprises a disk and a post, wherein;

the disk comprises a disk top surface, a disk bottom surface, a disk perimeter, and a plurality of tabs;

the post extends from the disk bottom surface, and wherein the post comprises a plurality of thickened portions;

the base is received by the cover through the bottom opening, and the plurality of tabs are received by the plurality of windows such that the base is located at an offset from the cover bottom edge;

the plurality of tabs extend perpendicularly through the plurality of windows;

the cover inner surface and the disk top surface define a sensor cavity for housing a sensor; and the disk bottom surface and the lower portion of the cover define a lower cavity, wherein the lower portion of the cover is solid to form a substantially sealed lower cavity;

the butt end of the grip is at least partially received in the lower cavity, and at least 50% of the grip surface is in contact with the disk bottom surface;

the post is received by the grip aperture to secure the sensor housing to the grip; and the sensor housing remains within the grip surface and does not overhang a perimeter of the grip.

2. The golf club of claim 1, wherein at least 75% of the grip surface is in contact with the disk bottom surface.

3. The golf club of claim 1, wherein the cover defines a height between 0.4 inch to 0.5 inch and an outer diameter between 0.85 inch to 1.00 inch.

4. The golf club of claim 1, wherein the sensor housing comprises a mass between 5 grams to 7 grams.

5. The golf club of claim 1, wherein the lower cavity defines a cavity depth between 0.05 inch to 0.065 inch.

6. The golf club of claim 1, wherein the plurality of windows can be 1 window, 2 windows, 3 windows, 4 windows, 5 windows, 6 windows, 7 windows, 8 windows, 9 windows, or 10 or more windows; and the plurality of windows corresponds to the plurality of tabs.

7. The golf club of claim 1, wherein the cover further comprises a plurality of ribs, wherein:

the plurality of ribs project from the cover inner surface into the sensor cavity;

the sensor is pinched between the cover inner surface, the plurality of ribs, and the disk top surface;

the plurality of ribs are positioned near the cover top edge;

the plurality of ribs retain the sensor in place; and the plurality of ribs can be 1 rib, 2 ribs, 3 ribs, 4 ribs, 5 ribs, 6 ribs, 7 ribs, 8 ribs, 9 ribs, or 10 or more ribs.

8. The golf club of claim 1, wherein:

the top opening defines a top opening diameter between 0.65 inch to 0.70 inch;

the bottom opening defines a bottom opening diameter between 0.85 inch to 0.90 inch; and the top opening diameter is smaller than the bottom opening diameter.

9. The golf club of claim 1, wherein the cover comprises a thickness between 0.01 inch to 0.15 inch.

10. The golf club of claim 1, wherein the cover is tapered near the cover bottom edge, and the cover is rounded near the cover top edge.

11. The golf club of claim 1, wherein the post and the disk are integral.

12. The golf club of claim 1, wherein the disk comprises a thickness between 0.01 inch to 0.15 inch, and further comprises a diameter between 0.75 inch to 0.90 inch.

13. The golf club of claim 1, wherein the plurality of tabs are parallel to the disk top surface.

14. The golf club of claim 1, wherein the plurality of tabs can be 1 tab, 2 tabs, 3 tabs, 4 tabs, 5 tabs, 6 tabs, 7 tabs, 8 tabs, 9 tabs, or 10 or more tabs.

15. The golf club of claim 1, wherein the plurality of tabs can comprise a similar shape to that of an adjacent tab, or a different shape to that of the adjacent tab.

16. The golf club of claim 1, wherein the plurality of windows comprise a rectangular shape, and the plurality of tabs comprise a rectangular shape.

17. The golf club of claim 1, wherein the base further comprises a base front side proximate a front side of the grip, and a base rear side proximate a rear side of the grip, and the post is located closer to the base front side.

18. The golf club of claim 1, wherein the post is centered on the disk bottom surface in a heel to toe direction.

19. The golf club of claim 1, wherein the post is threaded.

20. The golf club of claim 1, wherein the cover and the base are not removable once assembled.

* * * * *